US011383297B2

(12) United States Patent
Oh et al.

(10) Patent No.: US 11,383,297 B2
(45) Date of Patent: Jul. 12, 2022

(54) METHOD OF MANUFACTURING A METAL HYBRID, HEAT-DISSIPATING MATERIAL

(71) Applicant: KOREA INSTITUTE OF INDUSTRIAL TECHNOLOGY, Cheonan-si Chungcheongnam-do (KR)

(72) Inventors: Ik Hyun Oh, Gwangju (KR); Hyun Kuk Park, Gwangju (KR); Jun Ho Jang, Gwangju (KR); Hyun Rok Cha, Gwangju (KR); Jeong Han Lee, Gwangju (KR)

(73) Assignee: Korea Institute of Industrial Technology, Cheonan-si (KR)

( * ) Notice: Subject to any disclaimer, the term of this patent is extended or adjusted under 35 U.S.C. 154(b) by 185 days.

(21) Appl. No.: 16/400,412

(22) Filed: May 1, 2019

(65) Prior Publication Data

US 2019/0366429 A1 Dec. 5, 2019

(30) Foreign Application Priority Data

May 30, 2018 (KR) ..... 10-2018-0061787
Oct. 23, 2018 (KR) ..... 10-2018-0126907

(51) Int. Cl.
*B22F 1/00* (2022.01)
*B22F 3/16* (2006.01)

(52) U.S. Cl.
CPC ..... *B22F 1/0007* (2013.01); *B22F 3/16* (2013.01); *B22F 2302/40* (2013.01)

(58) Field of Classification Search
CPC ..... B22F 1/007; B22F 3/16; B22F 1/0007; B22F 2302/40; B22F 2998/10;
(Continued)

(56) References Cited

U.S. PATENT DOCUMENTS 7,851,055 B2 * 12/2010 Fukushima ..... C22C 32/0084 428/293.1
8,501,048 B2 * 8/2013 Ueno ..... H01L 23/373 252/503
(Continued)

FOREIGN PATENT DOCUMENTS

JP 2006-159654 A 6/2006
KR 10-2007-0114133 A 11/2007
(Continued)

OTHER PUBLICATIONS

Miyazaki Y, Miyawaki K, Uchino T, Kagawa Y. Dry Powder Coating using Planetary Centrifugal Mixer. J Pharm Pharm Sci. 2015;18 (3):460-73. doi: 10.18433/j3k31n. PMID: 26517137 (Year: 2015).*

*Primary Examiner* — John A Hevey
(74) *Attorney, Agent, or Firm* — Rabin & Berdo, P.C.

(57) ABSTRACT

A method of manufacturing a metal hybrid, heat-dissipating material includes the steps of (a) preparing a spherical metal powder and a flake graphite powder having an aspect ratio greater than 1, respectively; (b) preparing a powder mixture by inserting only the spherical metal powder and the flake graphite powder into a container, followed by dry mixing the powder mixture using a multi-axial mixing method for rotating or vibrating the container about two or more different rotation axes without any liquid input and without any mixing aids; (c) manufacturing a green compact by pressing the powder mixture; and (d) sintering the green compact to provide the metal hybrid, heat-dissipating material.

13 Claims, 24 Drawing Sheets

(58) Field of Classification Search
CPC ..... B22F 2999/00; B22F 1/025; C22C 1/05; C22C 1/1084; C22C 32/0084; H05K 7/2039
See application file for complete search history.

(56) References Cited

U.S. PATENT DOCUMENTS 9,044,717 B2 * 6/2015 Yao ..... B01F 9/0001
9,970,086 B2 * 5/2018 Mouri ..... B22F 1/007

FOREIGN PATENT DOCUMENTS

KR 10-2010-0051124 A 5/2010
KR 10-1169303 B1 7/2012
KR 10-1797671 B1 11/2017

* cited by examiner

METHOD OF MANUFACTURING A METAL HYBRID, HEAT-DISSIPATING MATERIAL

CROSS-REFERENCE TO RELATED PATENT APPLICATIONS

This application claims the benefit of Korean Patent Application No. 10-2018-0061787, filed on May 30, 2018, and Korean Patent Application No. 10-2018-0126907, filed on Oct. 23, 2018, in the Korean Intellectual Property Office, the disclosures of which are incorporated herein in their entireties by reference.

BACKGROUND

1. Field

The present invention relates to a metal hybrid heat-dissipating material and a method of manufacturing the same, and more particularly, to a method of manufacturing a highly-oriented metal hybrid heat-dissipating material having a high thermal conductivity.

2. Description of the Related Art

A heat-dissipating material is used to dissipate heat generated operation of a product, as fast as possible. Currently, due to the development of information technology (IT), high-integration, high-output, and high-performance electronic devices are used and thus heat generated from the electronic devices is increased. When heat generated during operation of a device is not dissipated fast, device performance is rapidly reduced such that product durability and reliability are lowered.

For example, when heat generated during operation of a light-emitting diode (LED) is not efficiently dissipated, an operation temperature of the LED is increased such that a lifespan of the LED is rapidly reduced. In addition, currently rapidly spread power semiconductor modules due to popularization of hybrid or electric motors of vehicles use a current of several ten amperes (A) to several hundred A and use a high voltage of several hundred volts (V). When high heat generated due to high power is not effectively prevented, device distortion or deformation may be caused and thus malfunction or damage may not be easily prevented.

To solve the above-described problems, researchers of some countries are currently developing a metal hybrid heat-dissipating material including graphite powder dispersed in a metal matrix having a high thermal conductivity. When graphite is oriented toward a certain direction in the metal matrix of the metal-graphite composite, thermal conductivity may be greatly increased in the direction toward which graphite is orientated and thus heating of a product may be effectively controlled. Such a heat-dissipating material is manufactured by mixing heterogeneous materials such as metal and graphite. Therefore, non-uniformity caused in a process of mixing and hybridizing different materials needs to be suppressed as much as possible to achieve high-density and uniform properties. As such, a technology for uniformly dispersing graphite powder in a metal matrix and a technology for increasing a degree of orientation are significant.

PRIOR ART DOCUMENT

Patent Document

Korean Patent Application No. 10-2011-0133435

SUMMARY

The present invention provides a metal hybrid heat-dissipating material capable of achieving a high thermal conductivity and a high thermal diffusivity by uniformly mixing metal powder and graphite powder to increase sinterability of the metal hybrid material and uniformly disperse the graphite powder, and by effectively controlling orientation of graphite in the metal powder toward one direction, and a method of manufacturing the same.

However, the scope of the present invention is not limited thereto.

According to an aspect of the present invention, there is provided a method of manufacturing a metal hybrid heat-dissipating material, the method including (a) preparing spherical metal powder and flake graphite powder having an aspect ratio greater than 1, (b) preparing mixture powder by inserting only the spherical metal powder and the flake graphite powder into a container and then mixing the metal powder and the graphite powder by using a multi-axial mixing method for rotating or vibrating the container about two or more different rotation axes, (c) manufacturing a green compact by pressing the mixture powder, and (d) sintering the green compact.

A variation in a median of sizes of the mixture powder before and after step (b) may be not greater than 3%.

Step (c) may include (c-1) filling a part of the mixture powder in a mold, (c-2) manufacturing a partial green compact by uniaxially pressing the filled mixture powder in the mold, and (c-3) manufacturing a final green compact by repeatedly filling another part of the mixture powder on the partial green compact and then uniaxially pressing the filled mixture powder, multiple times, and the green compact in step (d) may include the final green compact.

In step (c), a rate of the graphite powder controlled in such a manner that an angle between the graphite powder and a direction perpendicular to a pressing direction has an absolute value equal to or less than 20° (the rate is defined as an orientation control rate and a specific calculation method thereof will be described below), has a value equal to or higher than 70%.

The metal powder may include any one selected from among copper (Cu), silver (Ag), aluminum (Al), tungsten (W), titanium (Ti), molybdenum (Mo), gold (Au), nickel (Ni), and alloys thereof.

The metal powder may have a size of 1 μm to 100 μm.

The graphite powder may be coated with a metal film.

In this case, the metal film may include at least one of Cu, Ag, and Ni.

The metal film may be coated using any one selected from among electroless plating, electroplating, physical vapor deposition (PVD), and chemical vapor deposition (CVD).

The graphite powder may have a size of 1 μm to 1,000 μm.

In step (c-1), a weight ratio of the mixture powder filled in the mold to the total mixture powder may be higher than 0.04 and lower than 1.

In step (c), the uniaxial pressing may be performed in a range from 10 MPa to 100 MPa, and more preferably, in a range from 20 MPa to 60 MPa.

In step (d), the sintering may be performed using any one selected from among high-temperature sintering, hot pressing, and spark plasma sintering.

BRIEF DESCRIPTION OF THE DRAWINGS

The above and other features and advantages of the present invention will become more apparent by describing in detail embodiments thereof with reference to the attached drawings in which.

DETAILED DESCRIPTION

The following detailed descriptions of the invention will be made with reference to the accompanying drawings illustrating specific embodiments of the invention by way of example. These embodiments will be described in detail such that the invention can be carried out by one of ordinary skill in the art. It should be understood that various embodiments of the invention are different, but are not necessarily mutually exclusive. For example, a specific shape, structure, and characteristic of an embodiment described herein may be implemented in another embodiment without departing from the scope of the invention. In addition, it should be understood that a position or placement of each component in each disclosed embodiment may be changed without departing from the scope of the invention.

Hereinafter, to allow one of ordinary skill in the art to easily carry out the invention, embodiments of the present invention will be described in detail with reference to the accompanying drawings.

The present invention relates to a method of manufacturing a metal hybrid heat-dissipating material including a metal matrix and flake graphite powder dispersed in the metal matrix and having an aspect ratio greater than 1.

As used herein, an aspect ratio refers to a value obtained by dividing a length of the longest part (i.e., a major axis) of a graphite powder particle, by a length of the shortest part (i.e., a minor axis) thereof. In the case of flake graphite, the aspect ratio may refer to a value obtained by dividing a width of a flake particle by a thickness thereof. The aspect ratio may have various values based on shapes of graphite powder, e.g., values greater than 1 and equal to or less than 10,000, but the present invention is not limited thereto.

A metal hybrid heat-dissipating material of the present invention is manufactured by mixing metal powder and flake graphite powder and sintering the mixture powder. The metal powder may have various shapes such as a flake shape, a spherical shape, and an irregular shape. However, spherical metal powder capable of minimizing voids between powder particles in a precursor manufacturing process after a multi-axial mixing method to be described below, to achieve a high density in a sintering process may be the most suitable. In terms of particle size distribution of powder, when powder particles ranging from 1 μm to 100 μm are mixed, small powder particles may be filled between large powder particles and thus a dense precursor may be obtained. On the contrary, for example, using irregular or flake metal powder, unintended regions where voids between powder particles are not dense may locally occur in a sintering process.

Figure 1:
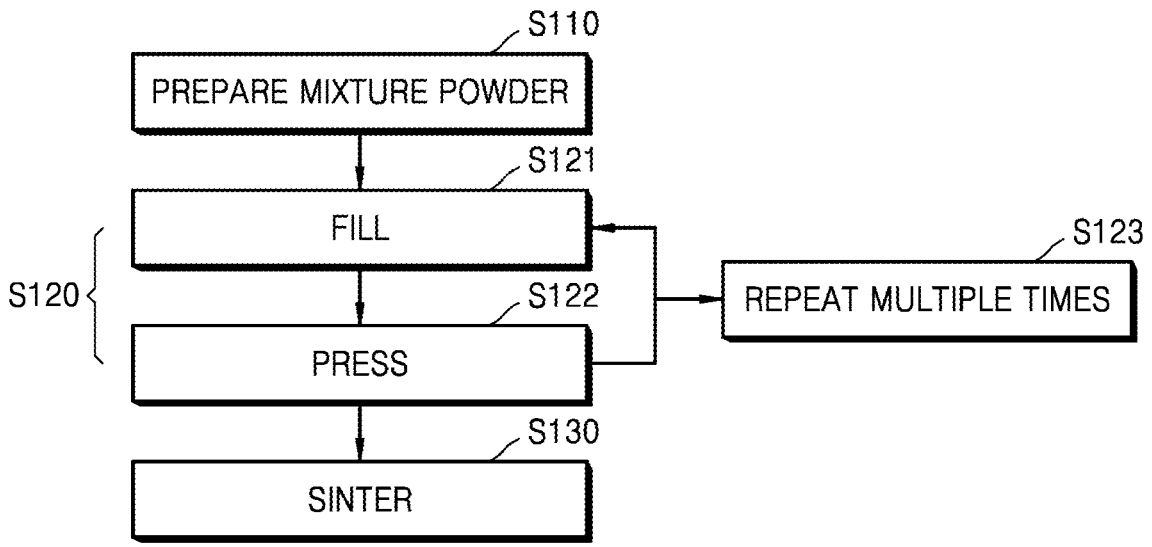
FIG. 1 is a flowchart of a method of manufacturing a metal hybrid heat-dissipating material, according to an embodiment of the present invention.

FIG. 1 is a flowchart of a method of manufacturing a metal hybrid heat-dissipating material, according to a first embodiment of the present invention.

Initially, as illustrated in FIG. 1, the method of manufacturing the metal hybrid heat-dissipating material, according to the first embodiment of the present invention, includes a first operation S110 for preparing mixture powder by mixing spherical metal powder and flake graphite powder, a second operation S120 for manufacturing a green compact by filling and pressing the mixture powder in a mold, and a third operation S130 for manufacturing a sintered compact by sintering the green compact.

Figure 3:
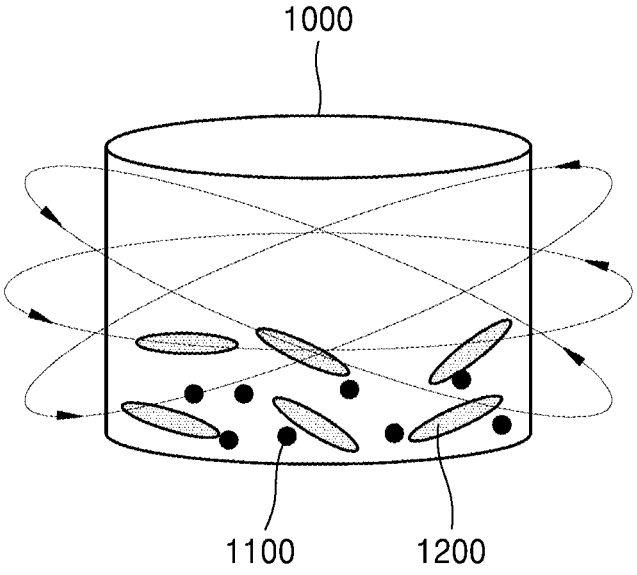
FIG. 3 is a conceptual view of a multi-axial mixer used in an embodiment of the present invention.

In the first operation S110, the mixture powder is prepared using a dry method, or more specifically, a multi-axial mixing method. Herein, the multi-axial mixing method refers to a method of inserting heterogeneous powders into a certain container and then mixing the powders by rotating or vibrating the container about two or more different rotation axes. FIG. 3 illustrates an examples of a multi-axial mixer. Referring to FIG. 3, spherical copper powder 100*b* and flake graphite powder 100*a* are inserted into a cylindrical container 1000, and the container 1000 rotates or vibrates sequentially about two or more different rotation axes. The rotation about each rotation axis may be performed in one rotation direction or alternately in opposite rotation directions. The vibration may be performed as rotational vibration with a certain cycle about each rotation axis. In this case, a speed of rotation may have a range from 1,000 revolutions per minute (rpm) to 3,000 rpm. When the speed of rotation is lower than 1,000 rpm, centrifugal force applied to mix the powders may not be sufficient. When the speed of rotation is higher than 3,000 rpm, coarse powder may be broken due to collision between the powders and metal powder may be oxidized due to frictional heat between the powders.

For rotation of the container 1000, a power source (not shown) for generating rotational power and a holder (not shown) for transmitting the power from the power source to the container 1000 may be provided under the container 1000. The holder is an element for stably supporting the container 1000 and may include a recess for mounting the container 1000 therein. The power source may be, for example, a motor.

In general, metal powder and graphite powder are mixed using a wet ball milling method. In the wet ball milling method, stainless steel balls or cemented carbide balls, material powder to be ground, and a processing control agent (PCA) are inserted together into a steel or stainless steel container at a proper ratio and then the container is rotated. In this case, the balls may rise along an inner wall of the container and then fall freely from a specific location. At this time, powder between the balls may be finely broken or alloyed. Since powder of a brittle material are finely ground or powder of a ductile material are pressure-welded to flakes by the balls after the process, the wet ball milling method is one of common powder mixing methods used for fine powder and powder alloying. However, the present inventors have found that an unintended problem occurs in a sintered compact when flake graphite powder and metal powder are mixed using a wet ball milling method.

Initially, when a ball mill is used, graphite powder is partially broken due to collision between hard balls and brittle coarse flake graphite powder during a mixing process and thus fine graphite powder is generated in the form of fragments. The generated fine graphite powder is dispersed between metal powder particles in a precursor manufacturing operation to hinder controlling of orientation of the coarse graphite powder. The fine graphite powder, which is uncontrollable in orientation, reduces thermal properties and hinders heat transfer paths of a precursor or a final product.

Furthermore, metal powder having a spherical shape is deformed to flake and irregular shapes due to mechanical collision with hard balls and thus voids between powder particles are widened in a precursor manufacturing process. As such, a high-density product may not be easily manufactured in a subsequent sintering operation.

In addition, metal oxides are generated due to increase in temperature when a liquid PCA inserted together with powders is dried and removed after a ball milling process, and remain in a product in a subsequent powder sintering operation. The metal oxides may reduce thermal conductivity.

On the contrary, when a dry multi-axial mixing method according to the present invention is used, since only metal powder and graphite powder are inserted into a container and then are mixed merely by rotation or vibration of the container, breakage of graphite powder or oxidation and deformation of metal powder according to a typical ball milling method may not occur. Therefore, the metal powder and the graphite powder may be constantly maintained in shape before and after multi-axial mixing, and a particle size of mixture powder may be hardly changed. For example, a variation in a median of powder sizes before and after multi-axial mixing (e.g., a percentage obtained by dividing a difference in medians before and after mixing, by the median before mixing) has a value less than 3%, and more strictly, a value less than 1%. In addition, since the powders are mixed in a dry manner without using a liquid PCA, oxidation due to the PCA may be fundamentally prevented.

According to a second embodiment modified from the first embodiment of the present invention, the second operation S120 for manufacturing the green compact by filling and pressing the mixture powder in the mold may be divided into a plurality of operations. Referring to FIG. 1, the second operation S120 includes a second-1 operation S121 for filling a part of the mixture powder in the mold, a second-2 operation S122 for manufacturing a partial green compact by pressing the mixture powder in the mold, and an operation S123 for repeating the second-1 and second-2 operations S121 and S122 multiple times.

Figure 4:
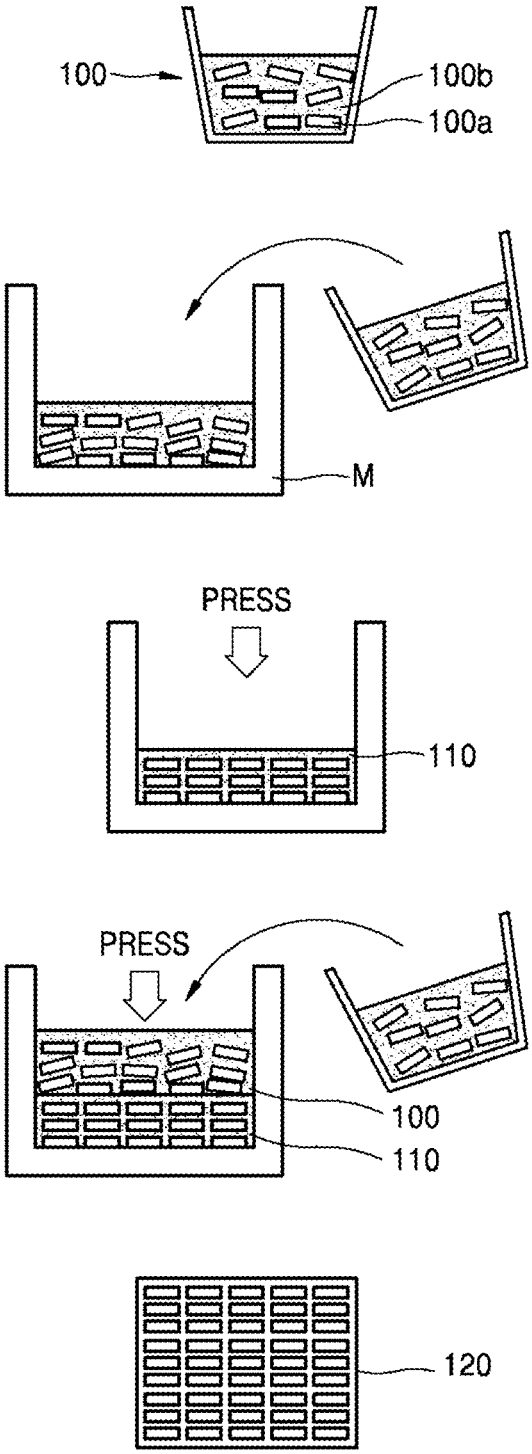
FIG. 4 is a schematic view for describing a method of manufacturing a metal hybrid heat-dissipating material, according to an embodiment of the present invention.

As illustrated in FIG. 4, the above-described method includes (a) preparing mixture powder 100 by mixing spherical metal powder 100*b* and graphite powder 100*a* having an aspect ratio greater than 1, by using a multi-axial mixing method, (b) filling a part of the mixture powder 100 in a mold M, (c) manufacturing a partial green compact 110 by uniaxially pressing the filled mixture powder 100 in the mold M, (d) manufacturing a final green compact by repeatedly filling another part of the mixture powder 100 on the partial green compact 110 and then uniaxially pressing the filled mixture powder 100, multiple times, and (e) manufacturing a sintered compact 120 by sintering the final green compact.

As such, a layered final green compact is manufactured by manufacturing partial green compacts by separately compressing parts of metal-graphite mixture powder, and stacking the manufactured partial green compacts on one another. The partial green compacts refer to green compacts manufactured due to pressing processes before the final green compact is manufactured.

In the second embodiment, when the operation of filling and pressing the mixture powder in the mold is performed N times, N partial green compacts may be manufactured. The final green compact may be understood as being manufactured by combining the N partial green compacts in terms of structure, or understood as being manufactured by sequentially stacking first to N-th partial green compacts on one another in the mold in terms of process.

For example, a green compact manufactured by filling ½ of total mixture powder in a mold and uniaxially pressing the filled mixture powder may be defined as a first partial green compact, and a green compact manufactured by filling the remaining mixture powder on the first partial green compact in the mold and uniaxially pressing the filled mixture powder may be defined as a second partial green compact. A final green compact may be understood as a precursor to be manufactured as a final product in a subsequent sintering operation.

The present invention has developed a heat-dissipating material having a high thermal conductivity in a uniaxial direction, by optimizing orientation of graphite powder by controlling a partial green compact manufacturing operation.

In the first and second embodiments, the metal powder of the mixture powder may include any one selected from among copper (Cu), silver (Ag), aluminum (Al), tungsten (W), titanium (Ti), molybdenum (Mo), gold (Au), nickel (Ni), and alloys thereof. In this case, the metal powder may have a size (e.g., an average diameter) of 1 μm to 100 μm.

The flake graphite powder may use, for example, planar graphite powder having (002) and (004) phases as a crystal structure.

In the current embodiment, the graphite powder may have a size of 1 μm to 1,000 μm. Herein, the size of the graphite powder refers to the length of a major axis. When the size of the graphite powder is less than 1 μm, the metal powder and the graphite powder may be layered in a mixing process due to fine graphite powder and thus a uniformly sintered compact may not be easily manufactured. Otherwise, when the size of the graphite powder is greater than 1,000 μm, a bad influence may be exerted on sinterability and the strength of a sintered compact. Preferably, particles of the graphite powder may have a size of 1 μm to 600 μm, or more preferably, a size of 50 μm to 600 μm.

In the current embodiment, the graphite powder may be coated with a metal film.

According to the first and second embodiments, the metal powder and the graphite powder may be mixed at a volume ratio of 3:7 to 7:3.

When the volume ratio of the metal powder to the total mixture powder is lower than 0.3, since graphite is dominant in a bulk material, brittleness of a product may be increased and a sound product may not be manufactured. Otherwise, when the volume ratio of the metal powder is higher than 0.7, compared to a product having a low volume ratio of the metal powder, a low thermal conductivity and a high weight may be obtained and a thermal expansion coefficient may be increased.

After the first operation S110 is finished, the operation of pressing the mixture powder may be performed, for example, by uniaxially pressing the mixture powder filled in the mold, in a direction (e.g., an arrow direction) perpendicular to a bottom surface as illustrated in FIG. 4D by using a pressing member insertable into the mold.

Figure 5:
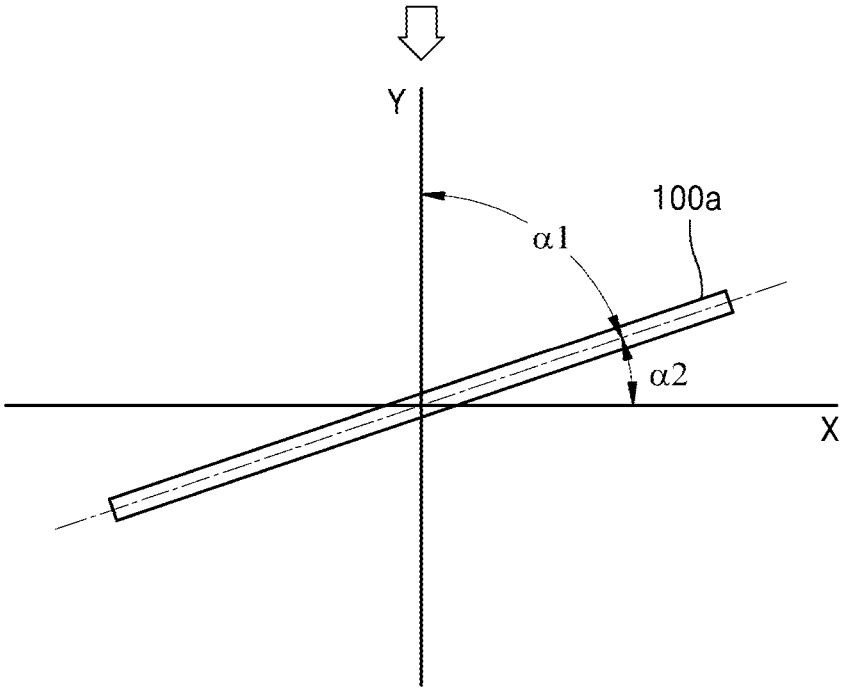
FIG. 5 is a graph schematically showing that graphite powder is oriented in a pressing operation, according to the present invention.
Figure 6A:
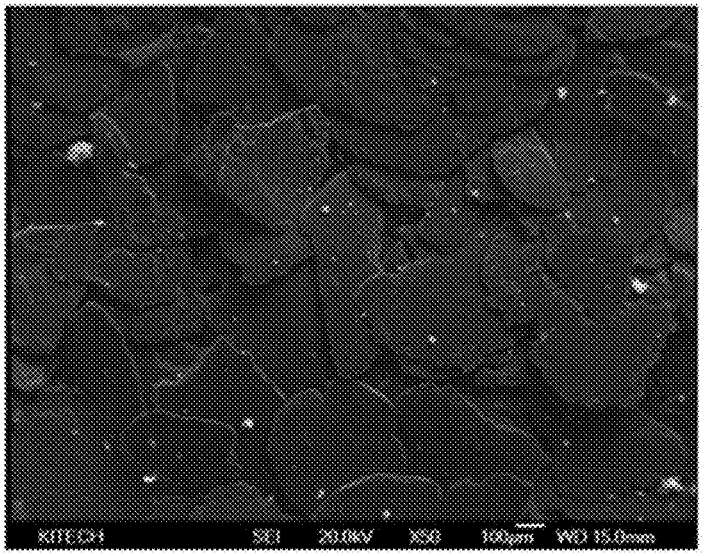
FIGS. 6A to 6D are scanning electron microscopic (SEM) images showing shapes of graphite powder and copper powders used to manufacture mixture powders.
Figure 6B:
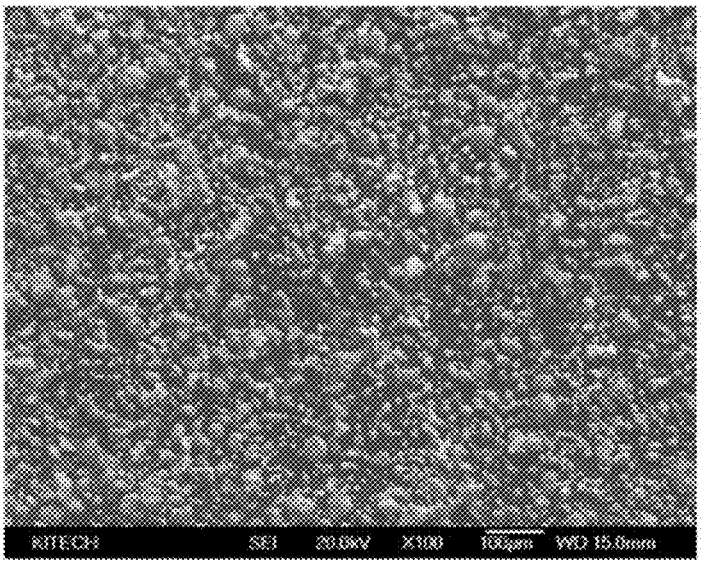
Figure 6C:
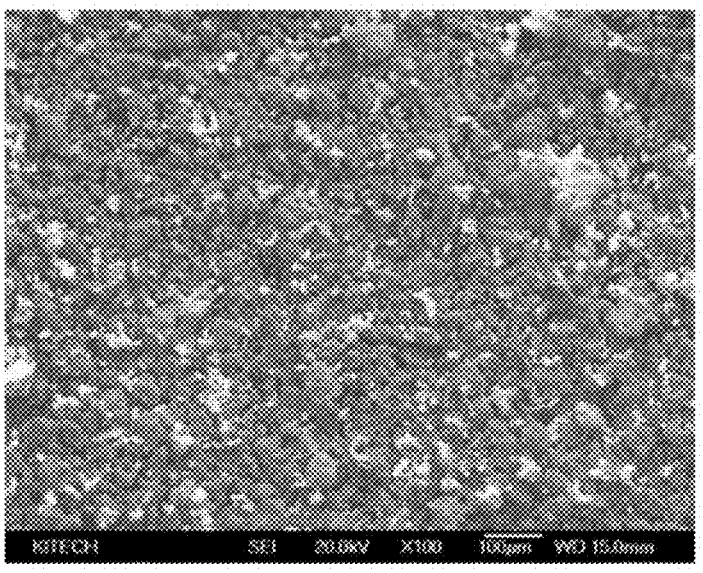
Figure 6D:
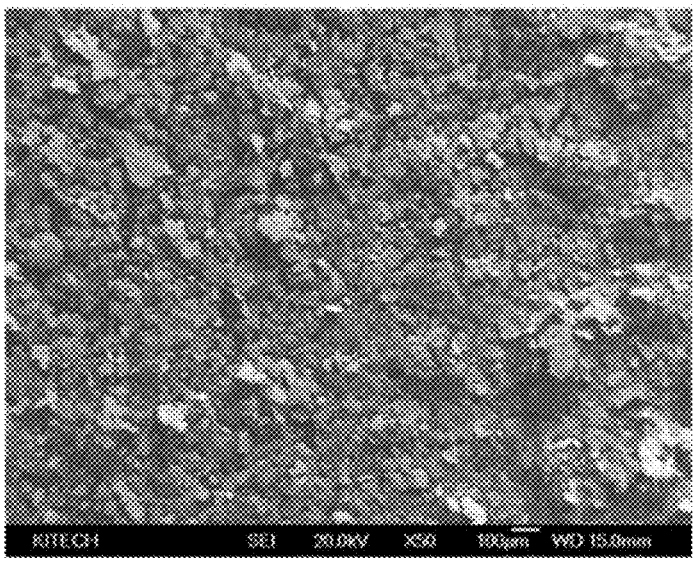
Figure 7A:
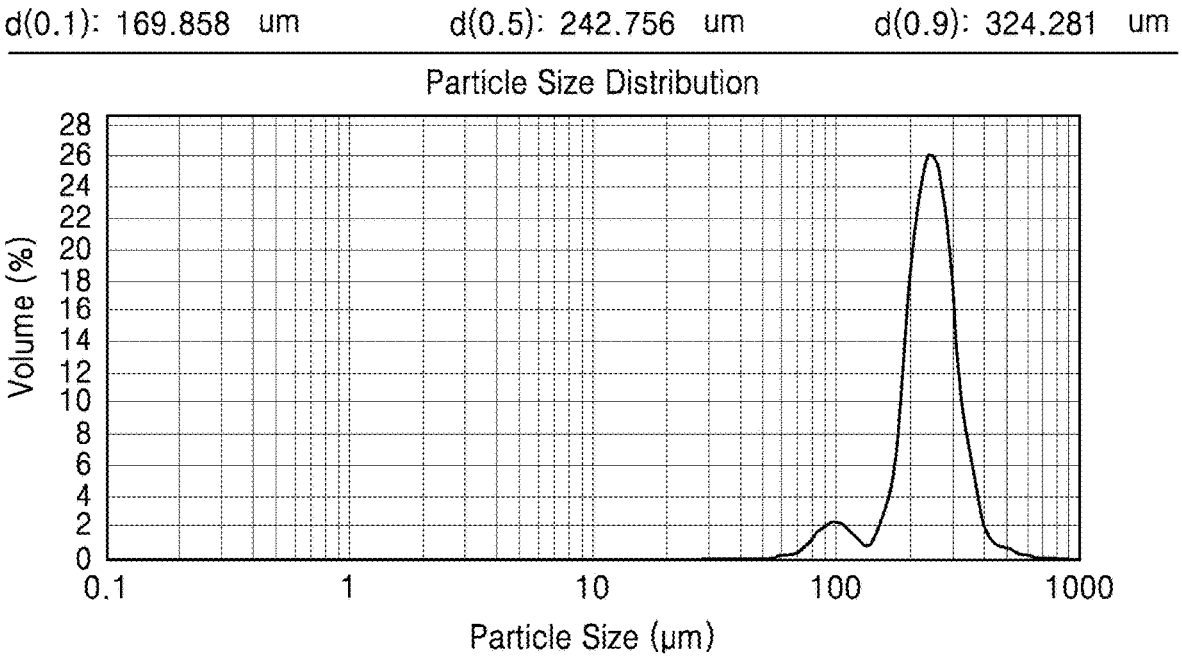
FIGS. 7A to 7D are graphs showing results of analyzing particle sizes of graphite powder and copper powders used to mix powders.
Figure 7B:
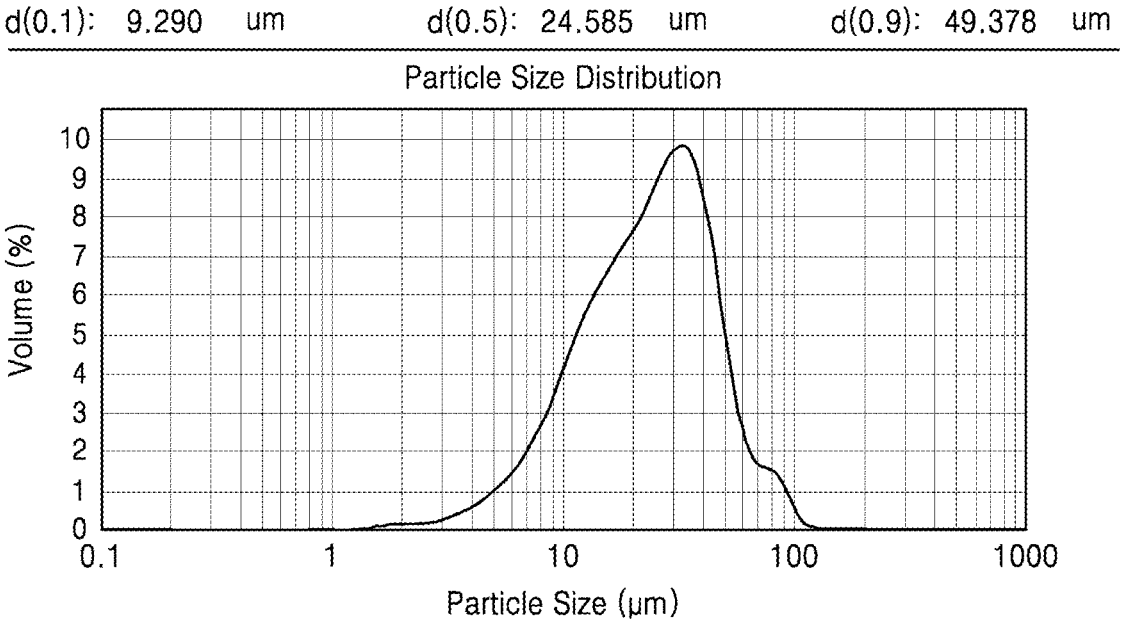
Figure 7C:
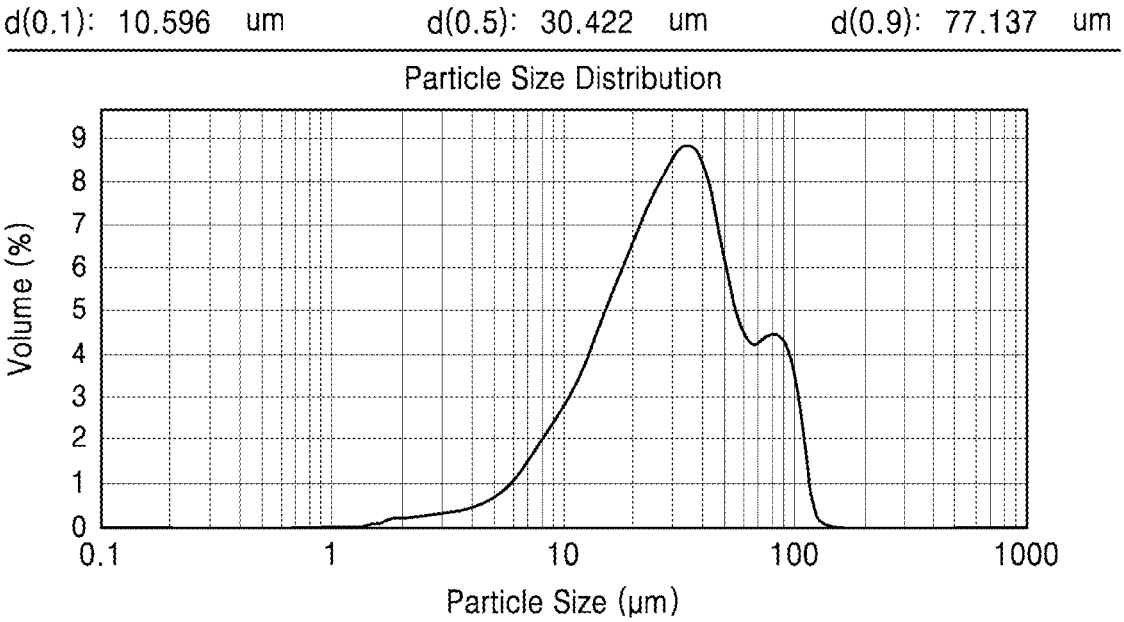
Figure 7D:
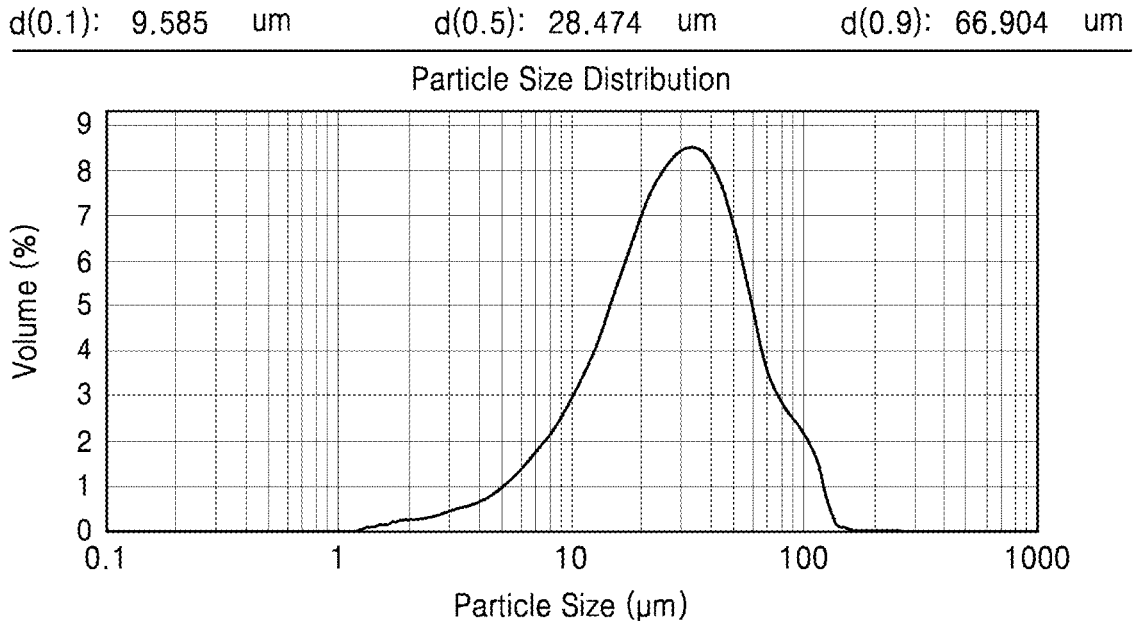

Referring to FIG. 5, the pressing operation may be performed in such a manner that a first angle $\alpha 1$ between the pressing direction (e.g., the arrow direction) and a major axis of at least a part of the graphite powder 100*a* included in the mixture powder is greater than a second angle $\alpha 2$ between the major axis and a direction perpendicular to the pressing direction. Since the graphite powder included in the mixture powder has an aspect ratio greater than 1, there is a high probability that the major axis of the graphite powder having a long length is oriented toward the direction perpendicular to the pressing direction due to pressure applied in the pressing operation.

The uniaxial pressing may be performed at a pressure of 10 MPa to 100 MPa, preferably, at a pressure of 10 MPa to 60 MPa, or more preferably, at a pressure of 20 MPa to 60 MPa. When the pressure is low, a contact ratio with the surface of the mixture powder may be low and thus force for orienting the graphite powder toward the direction perpendicular to the pressing direction may not be effectively transferred to the graphite powder. Therefore, a degree of orientation of the graphite powder is reduced. Otherwise, when the pressure is excessively high, the graphite powder in the mixture powder may be broken. Alternatively, when graphite powder coated with a metal film is used as described below, the metal film may be exfoliated. The breakage of the graphite powder or the exfoliation of the metal film exerts a bad influence on increase in thermal conductivity.

In the second embodiment of the present invention, when only a part of the total mixture powder is filled and uniaxially pressed in the mold, the pressure to be transferred to the graphite powder included in the mixture powder may be uniformly applied to the mixture powder and thus a probability that the major axis of the graphite powder is oriented to be perpendicular to the pressing direction may be increased.

That is, when the volume of the mixture powder filled in the mold is excessively large, a dead zone where the pressure applied from outside does not reach the inside of the mixture powder may occur. In the dead zone, the effect of orienting the major axis of the graphite powder to be perpendicular to the pressing direction due to the pressure may not be achieved. To prevent the dead zone, a very high pressure needs to be applied into the mold. In this regard, a device for applying such a high pressure and a special mold capable of withstanding the high pressure are required.

However, according to an embodiment of the present invention, an appropriate amount of mixture powder may be filled and pressed in a mold considering a pressure and thus a dead zone in the mixture powder may be prevented. That is, the pressure may be uniformly applied to graphite powder and thus a degree of orientation of a major axis of the graphite powder toward a specific direction may be increased. By sequentially stacking partial green compacts each including highly-oriented graphite powder, on one another in the mold, a final green compact including highly-oriented graphite powder may be manufactured.

According to the technical feature of the present invention, an orientation control rate defined as a rate by which graphite powder is oriented toward a specific direction may have a value equal to or higher than 70%, preferably, a value equal to or higher than 75%, more preferably, a value equal to or higher than 80%, more preferably, a value equal to or higher than 85%, more preferably, a value equal to or higher than 90%, or more preferably, a value equal to or higher than 95%.

To achieve the above-described effect of the present invention, a weight ratio of the mixture powder filled in the mold at a time in the second-1 operation S121, to the total mixture powder ultimately filled in the mold (i.e., a weight of the mixture powder filled at a time/a total weight of the mixture powder) may have, for example, a range from 0.04 to 1, preferably, a range from 0.05 to 0.7, or more preferably, a range from 0.05 to 0.5. When the weight ratio of the mixture powder is excessively small, the number of times that a pressing operation is repeated may be increased and thus efficiency of production may be reduced. When the weight ratio of the mixture powder is excessively large, the above-described problem of a dead zone may occur.

The manufactured final green compact is sintered. The final green compact may be sintered using, for example, high-temperature sintering, hot pressing, or spark plasma sintering.

A sintering temperature may be properly selected considering, for example, a melting point, a diffusion coefficient, and oxidation of the metal powder of the mixture powder (or a metal of a metal film in a case when graphite powder coated with the metal film is used as described below). For example, the sintering temperature may have a range from 400° C. to 2,000° C. depending on the type of the metal. In the case of Al having a low melting point, sintering may be performed in a range from 400° C. to 500° C. In the case of Cu, sintering may be performed at a temperature equal to or higher than 550° C. at which CuO decomposes, for example, in a range from 600° C. to 900° C. In the case of Ag, sintering may be performed in a range from 650° C. to 900° C. In the case of Mo or W having a high melting point, sintering may be performed in a range from 1,000° C. to 2,000° C.

A pressure may be applied during the sintering process to increase a relative density of the sintered compact. In this case, the applied pressure may be 40 MPa to 100 MPa. During the sintering process, densification may occur between the powders and pores between grains may be removed to increase the relative density. For example, the relative density of the sintered heat-dissipating material may be equal to or higher than 95%, preferably, equal to or higher than 98%, or more preferably, equal to or higher than 99%.

Figure 2:
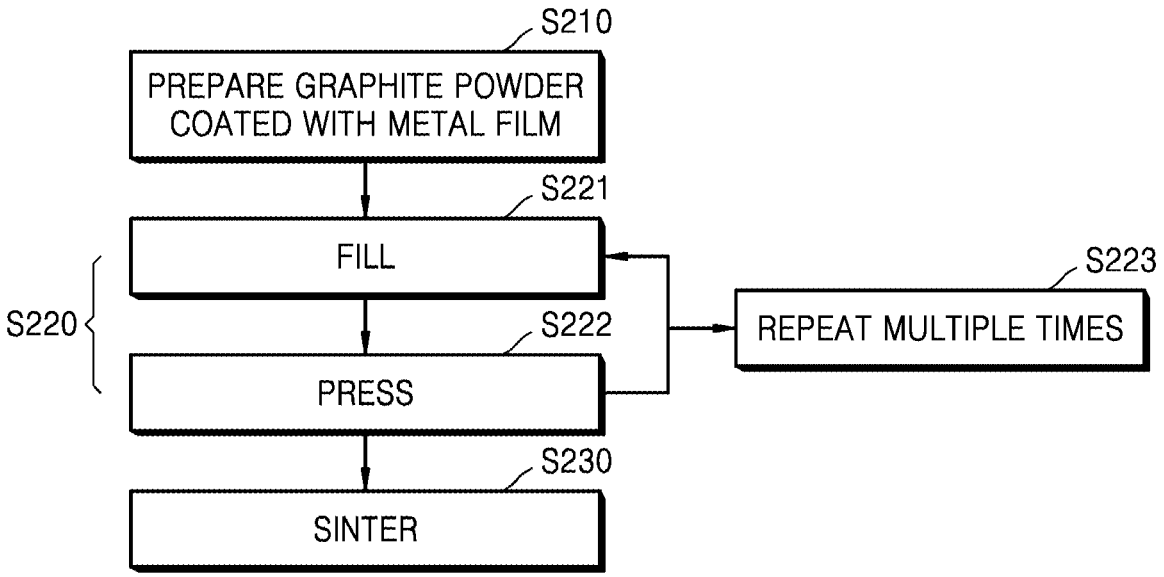
FIG. 2 is a flowchart of a method of manufacturing a metal hybrid heat-dissipating material, according to another embodiment of the present invention.

FIG. 2 is a flowchart of a method of manufacturing a metal hybrid heat-dissipating material, according to a third embodiment of the present invention.

As illustrated in FIG. 2, the method of manufacturing the heat-dissipating material, according to the third embodiment of the present invention, includes a first operation S210 for preparing flake graphite powder coated with a metal film, a second operation S220 for manufacturing a green compact by filling and pressing the graphite powder coated with the metal film, in a mold, and a third operation S230 for manufacturing a sintered compact by sintering the green compact.

According to a fourth embodiment modified from the third embodiment, the second operation S220 for manufacturing the green compact by filling and pressing the flake graphite powder coated with the metal film, in the mold may be divided into a plurality of operations. Referring to FIG. 2, the second operation S220 includes a second-1 operation S221 for filling a part of the graphite powder in the mold, a second-2 operation S222 for manufacturing a partial green compact by pressing the graphite powder in the mold, and an operation S223 for repeating the second-1 and second-2 operations S221 and S222 multiple times.

According to the third and fourth embodiments, the metal film coated on the graphite powder may include at least one of Cu, Ag, and Ni.

The metal film may be coated using any one selected from among electroless plating, electroplating, physical vapor deposition (PVD), and chemical vapor deposition (CVD).

For example, when the metal film is coated on the surface of the graphite powder by using electroless plating, the whole surface of the graphite powder needs to be in an activated state to increase efficiency of coating. In this regard, the graphite powder may be activated before the metal film is coated. The graphite powder may be activated using various methods, e.g., a method of heating the graphite powder to a proper temperature to remove a volatile substance, an adsorbed gas, etc. from the surface of the graphite powder, a method using $PdCl_2$ solution, and a method of adding an organic additive.

A wetting process may be additionally performed to increase wettability of the activated graphite powder. In this case, a method of adding acetic acid to the graphite powder may be used to increase wettability.

A cleaning process may be additionally performed to remove oxides and impurities remaining on the electroless-plated powder. In this case, the cleaning process may be performed using a method of washing the powder with distilled water 5 to 20 times.

A passivation process may be performed to prevent oxidation of the manufactured powder. In this case, the passivation process may be performed by dipping the powder in a mixture solution of distilled water, sulfuric acid, phosphoric acid, and tartaric acid.

The present invention further includes a method of manufacturing a sintered compact by mixing spherical metal powder and flake graphite powder coated with a metal film, and then pressing and sintering the mixture powder. All operations from the operation of manufacturing the mixture powder to the operation of sintering the mixture powder are the same as those described above and thus detailed descriptions thereof will not be provided herein.

The heat-dissipating materials manufactured according to the afore-described embodiments have a high thermal conductivity in a uniaxial direction.

The thermal conductivity of the copper-graphite heat-dissipating material manufactured according to the first or second embodiment, at room temperature may be equal to or higher than 500 W/mK, preferably, equal to or higher than 550 W/mK, more preferably, equal to or higher than 570 W/mK, or more preferably, equal to or higher than 600 W/mK.

The thermal conductivity of the copper-graphite heat-dissipating material manufactured according to the third or fourth embodiment, at room temperature may be equal to or higher than 450 W/mK, or preferably, equal to or higher than 500 W/mK.

The thermal conductivity of the silver-graphite heat-dissipating material manufactured according to the first or second embodiment, at room temperature may be equal to or higher than 500 W/mK, preferably, equal to or higher than 550 W/mK, more preferably, equal to or higher than 570 W/mK, or more preferably, equal to or higher than 600 W/mK.

The thermal conductivity of the silver-graphite heat-dissipating material manufactured according to the third or fourth embodiment, at room temperature may be equal to or higher than 400 W/mK, or preferably, equal to or higher than 450 W/mK.

The thermal conductivity of the aluminum-graphite heat-dissipating material manufactured according to the first or second embodiment, at room temperature may be equal to or higher than 240 W/mK, preferably, equal to or higher than 270 W/mK, or more preferably, equal to or higher than 300 W/mK.

Experimental examples for facilitating understanding of the present invention will now be described. However, the following experimental examples are provided only for a better understanding of the present invention and the present invention is not limited thereto.

FIGS. 6A to 6D are scanning electron microscopic (SEM) images showing shapes of flake graphite powder and spherical, irregular, and flake copper powders used to manufacture samples. FIGS. 7A to 7D are graphs showing results of analyzing particle sizes of the powders by using a powder particle size analyzer. In terms of a median of particle sizes of each powder, the graphite powder has a particle size of 240.2 μm, the spherical copper powder has a particle size of 24.5 μm, the irregular copper powder has a particle size of 30.4 μm, and the flake copper powder has a particle size of 28.4 μm.

Table 1 shows conditions for manufacturing copper-graphite (Cu—C) mixture powder by using the above-mentioned graphite and copper powders.

TABLE 1

| Sample | Mixing ratio | Copper powder | Graphite powder | Powder mixing | d1(0.5) (μm) | d2(0.5) (μm) |
|---|---|---|---|---|---|---|
| Sample 1 | 5:5 | spherical | flake | multi-axial mixing | 261.6 | 261.2 |
| Sample 2 | 5:5 | irregular | flake | multi-axial mixing | 303.8 | 303.6 |
| Sample 3 | 5:5 | spherical | flake | ball mill | 261.6 | 177.5 |
| Sample 4 | 5:5 | irregular | flake | ball mill | 303.8 | 247.2 |
| Sample 5 | 5:5 | flake | flake | multi-axial mixing | 122.2 | 109.6 |
| Sample 6 | 5:5 | flake | flake | ball mill | 122.2 | 97.5 |

Sample 1 is manufactured by inserting spherical copper powder and flake graphite powder having an aspect ratio greater than 1, into a multi-axial mixer at a volume ratio shown in Table 1 and then uniformly mixing the powders at 2,500 rpm for about 1 hour.

Sample 2 is manufactured in the same manner as Sample 1 except that irregular copper powder is used.

Sample 3 is manufactured by mixing spherical copper powder and flake graphite powder like Sample 1 by using a wet ball milling method. Specifically, the copper powder, the graphite powder, and ethanol are inserted into a ball mill chamber together with stainless steel balls and then the ball mill chamber is rotated at 150 rpm for 10 minutes to mix the powders. In this case, a weight ratio of the balls to the mixture powder inserted into the ball mill, i.e., a ball to powder ratio (BPR), is 3:1. After the mixing process is completed, mixture powder slurry is obtained from the ball mill chamber and then is dried using hit air at 70° C. for 1 hour to obtain mixture powder.

Sample 4 is manufactured in the same manner as Sample 3 except that irregular copper powder is used. Sample 5 is manufactured in the same manner as Sample 1 except that flake copper powder is used. Sample 6 is manufactured in the same manner as Sample 3 except that flake copper powder is used.

Variations in particle sizes of mixture powders based on powder mixing methods are analyzed. Initially, a particle size of mixture powder obtained by physically mixing copper powder and graphite powder by a user is measured, and particle sizes of mixture powders obtained by mixing copper powder and graphite powder by using a multi-axial mixer and a ball mill are measured.

Figure 8A:
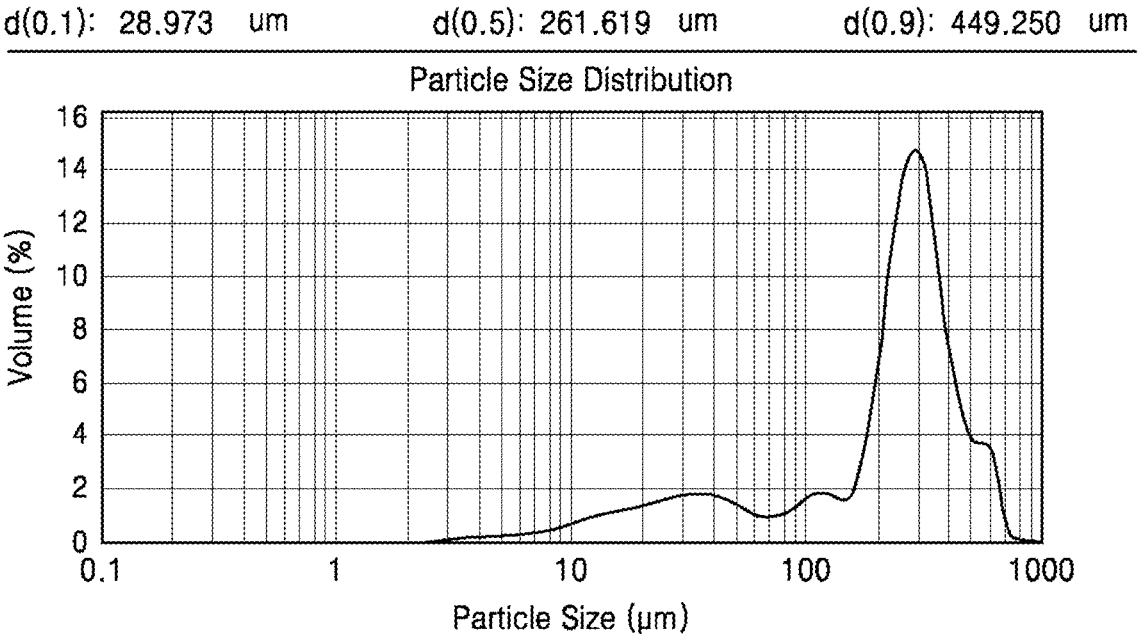
FIGS. 8A to 8C are graphs showing particle size variations based on methods of mixing spherical copper powder.
Figure 8B:
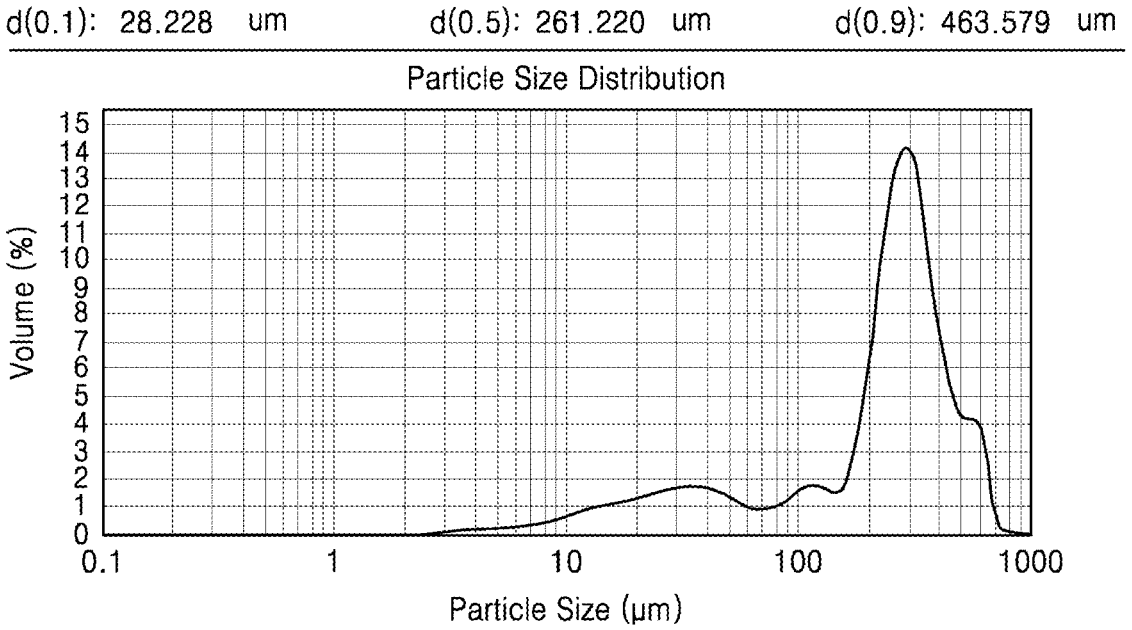
Figure 8C:
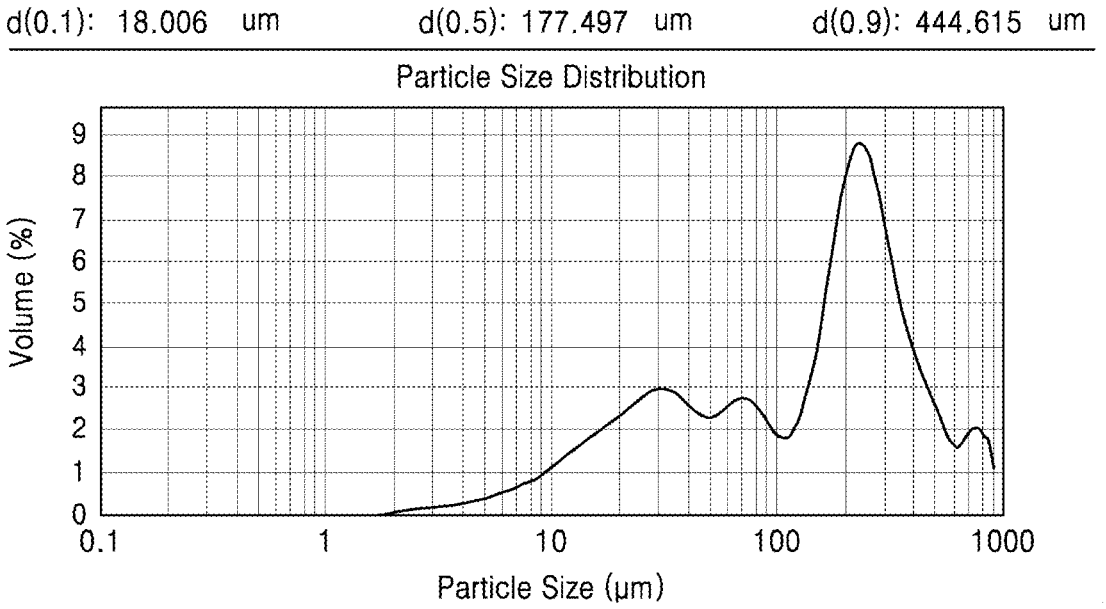
Figure 9A:
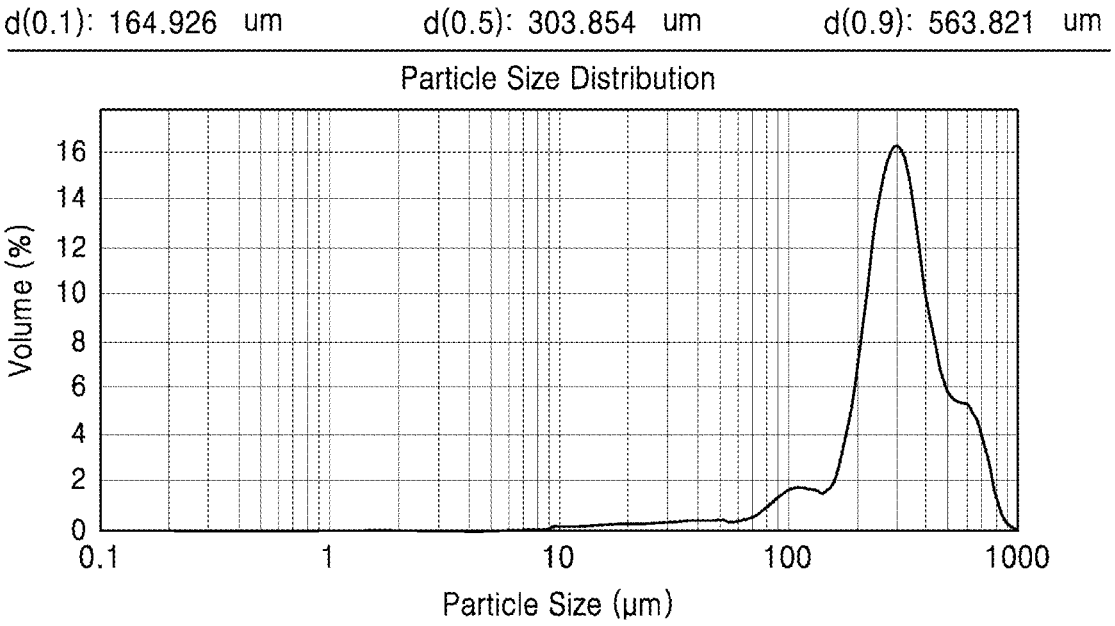
FIGS. 9A to 9C are graphs showing particle size variations based on methods of mixing irregular copper powder.
Figure 9B:
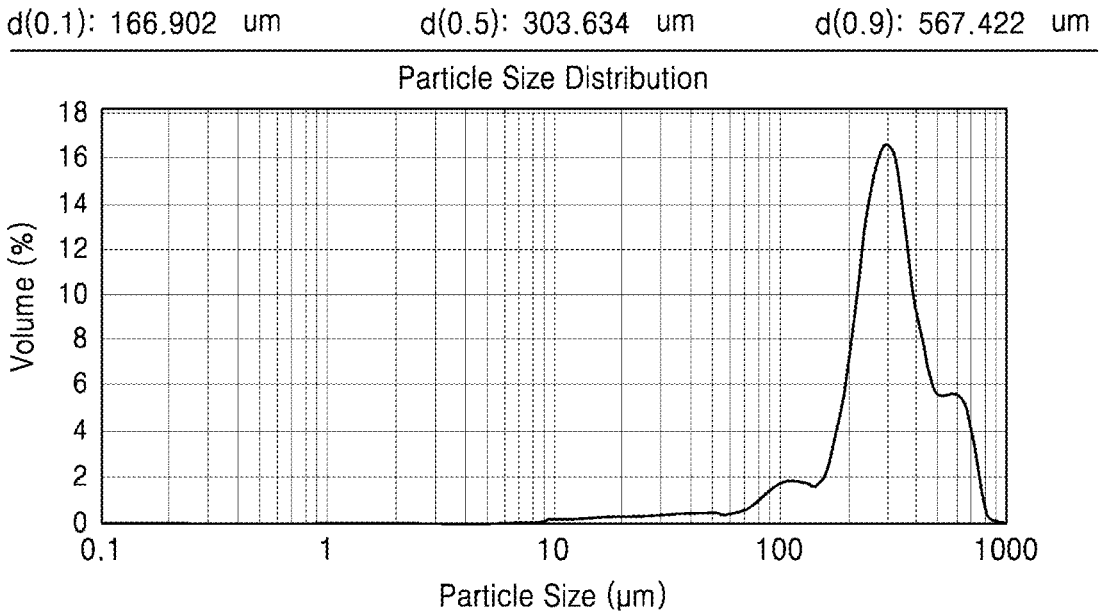
Figure 9C:
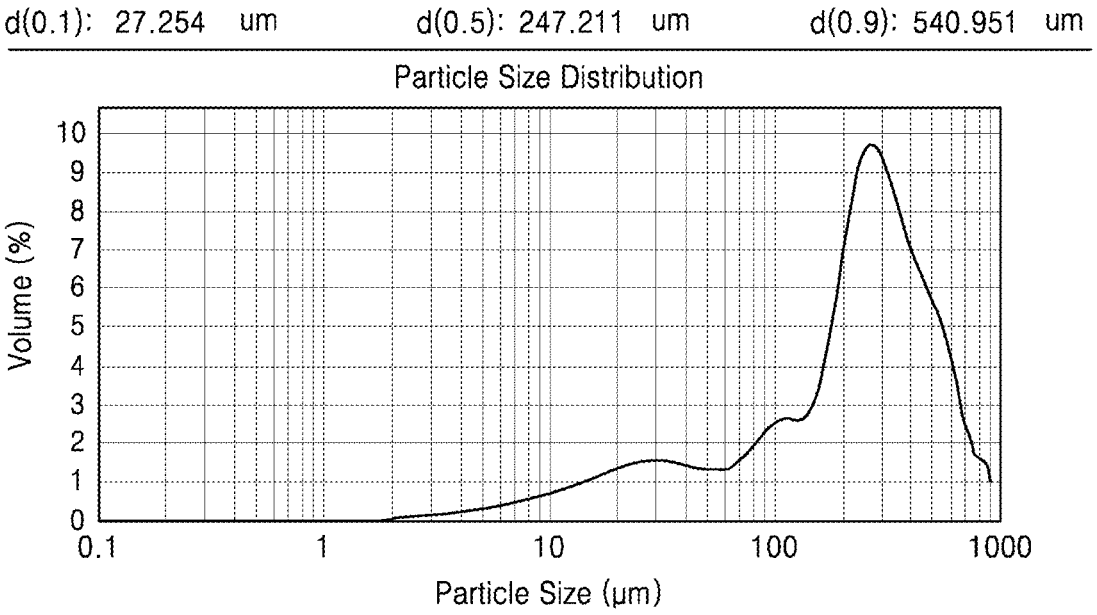
Figure 10A:
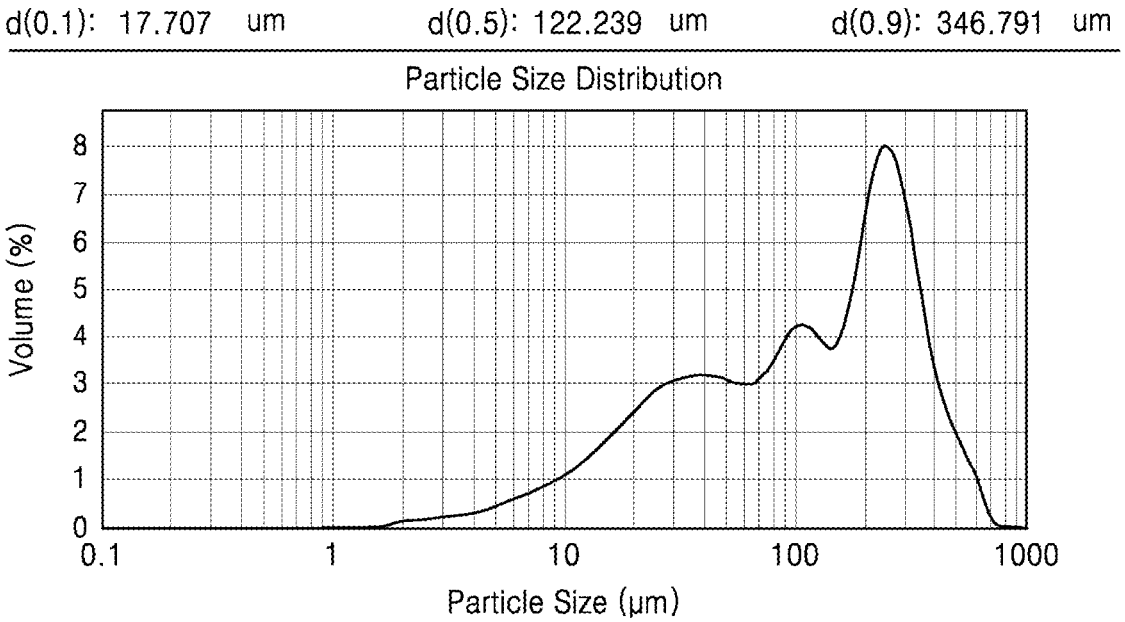
FIGS. 10A to 10C are graphs showing particle size variations based on methods of mixing flake copper powder.
Figure 10B:
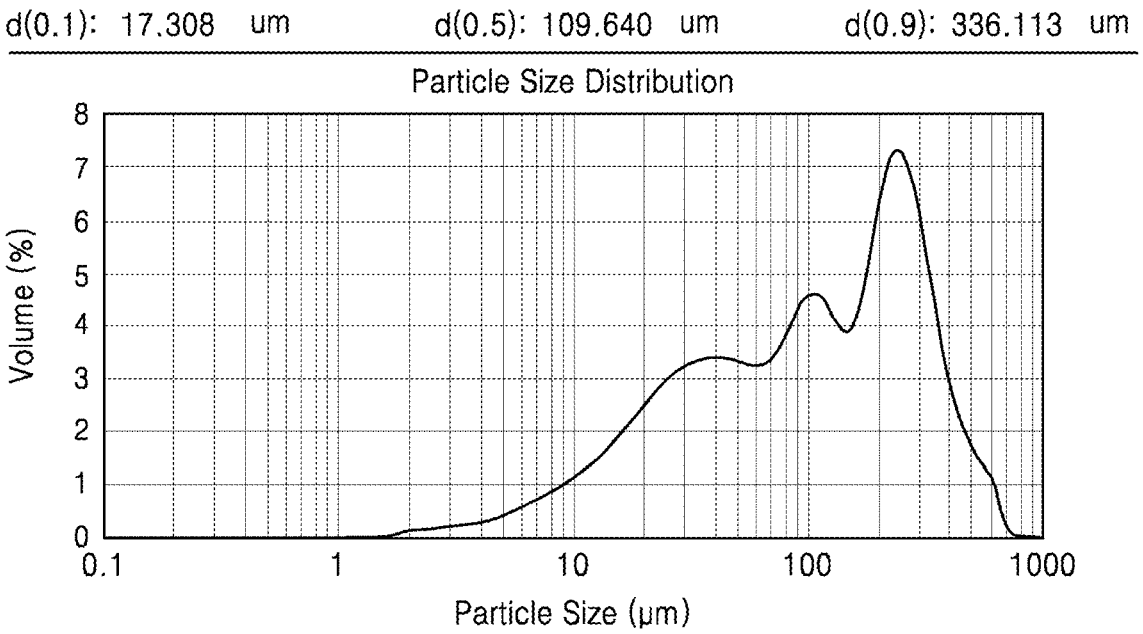
Figure 10C:
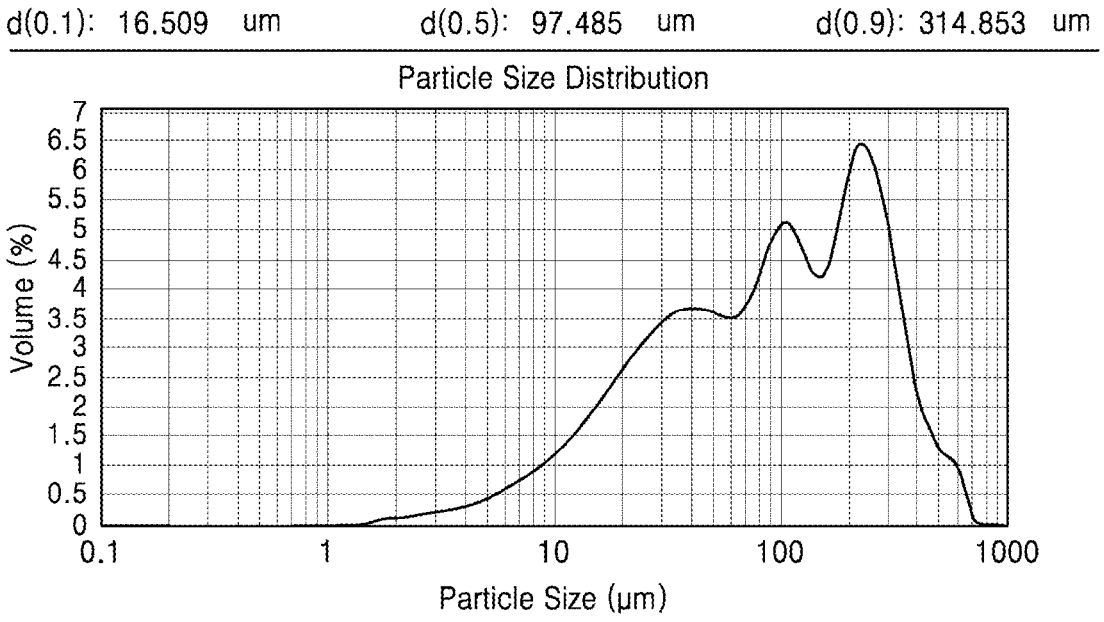

FIGS. 8A to 8C are graphs showing particle size variations based on methods of mixing flake graphite powder and spherical copper powder. FIG. 8A shows particle size distribution before the powders are inserted into a mixer, and FIGS. 8B and 8C show particle size distributions after the powders are mixed using a multi-axial mixer and a ball mill (Samples 1 and 3), respectively. FIGS. 9A to 9C show results of flake graphite powder and irregular copper powder. FIG. 9A shows particle size distribution before the powders are inserted into a mixer, and FIGS. 9B and 9C show particle size distributions after the powders are mixed using a multi-axial mixer and a ball mill (Sample 2 and Sample 4), respectively. FIGS. 10A to 10C show results of flake graphite powder and flake copper powder. FIG. 10A shows particle size distribution before the powders are inserted into a mixer, and FIGS. 10B and 10C show particle size distributions after the powders are mixed using a multi-axial mixer and a ball mill (Sample 5 and Sample 6), respectively.

Table 1 shows medians. In Table 1, d1(0.5) and d2(0.5) denote medians of mixture powder before and after the mixture powder is inserted into a mixer.

Referring to FIGS. 8A to 8C, 9A to 9C, and 10A to 10C, and Table 1, Samples 3, 4, and 6 mixed using a ball mill show noticeable variations in particle size distribution before and after the powders are mixed. On the contrary, Samples 1, 2, and 5 mixed using a multi-axial mixer show no or little variations in particle size distribution compared to a ball mill regardless of the shape of the copper powder.

Referring to FIGS. 8C, 9C, and 10C, it is shown that fine powder having a size equal to or less than 100 μm, which is provided in a small amount before being inserted into a ball mill, is greatly increased after the mixing process using a ball mill. It is regarded that the increase in the amount of fine powder is caused by fine graphite powder generated due to breakage of the flake graphite powder during the ball milling process.

Figure 11A:
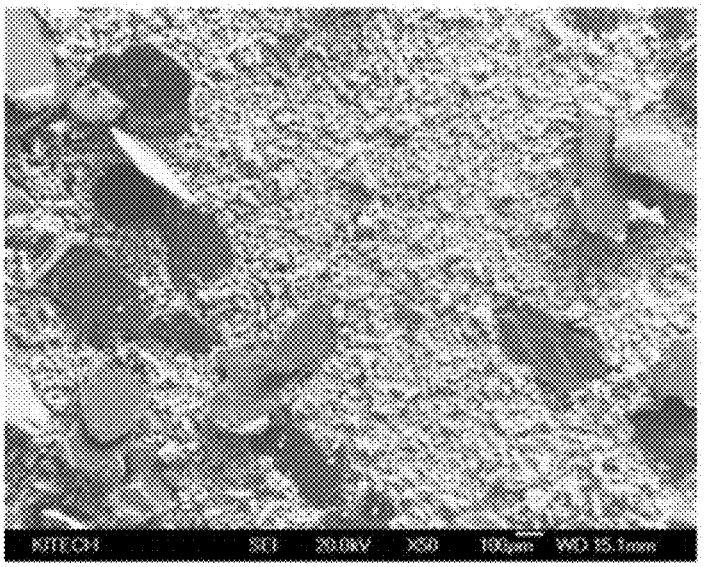
FIGS. 11A to 11C are SEM images showing shapes of mixture powders according to Samples 1, 2, and 5 after a mixing process using a multi-axial mixer is completed.
Figure 11B:
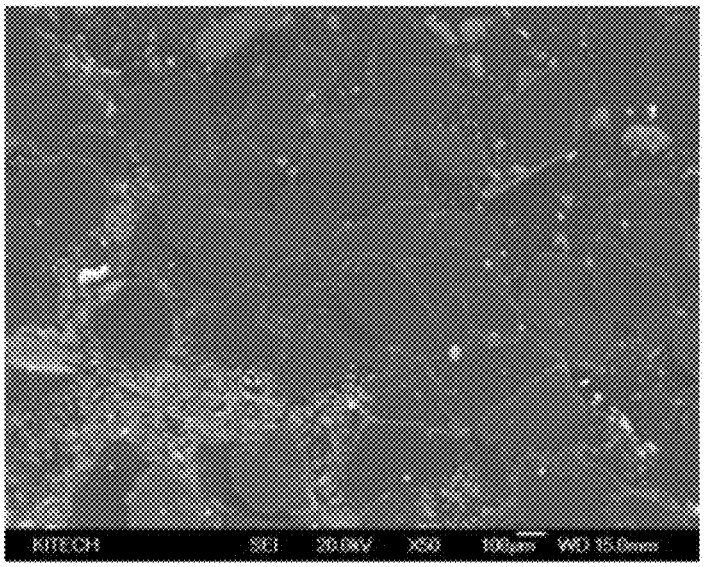
Figure 11C:
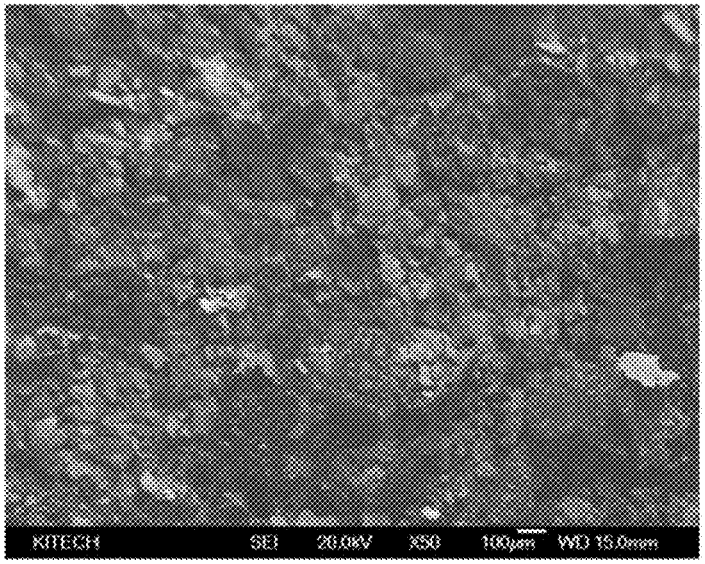

FIGS. 11A to 11C are SEM images showing shapes of mixture powders according to Samples 1, 2, and 5 after a mixing process using a multi-axial mixer is completed.

Referring to FIGS. 11A and 11B, when a multi-axial mixer is used, variations in shapes of the copper powder and the graphite powder before and after being mixed are not shown.

Figure 12A:
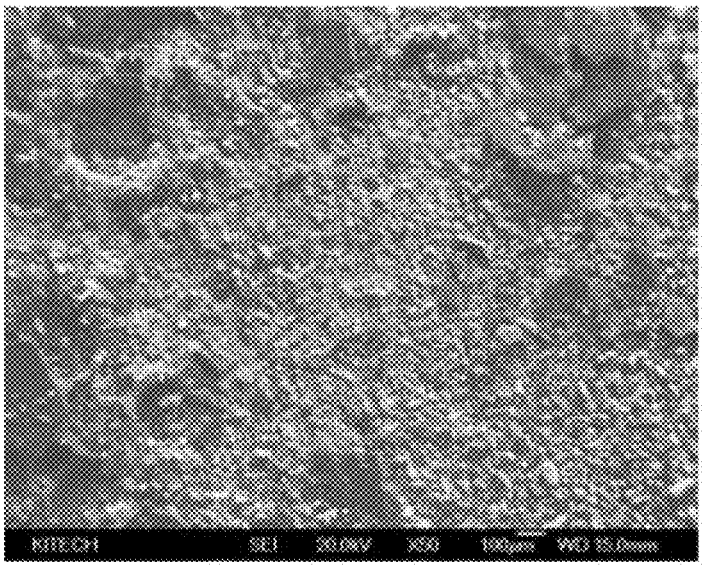
FIGS. 12A to 12C are SEM images showing shapes of mixture powders according to Samples 3, 4, and 6 after a mixing process using a ball mill is completed.
Figure 12B:
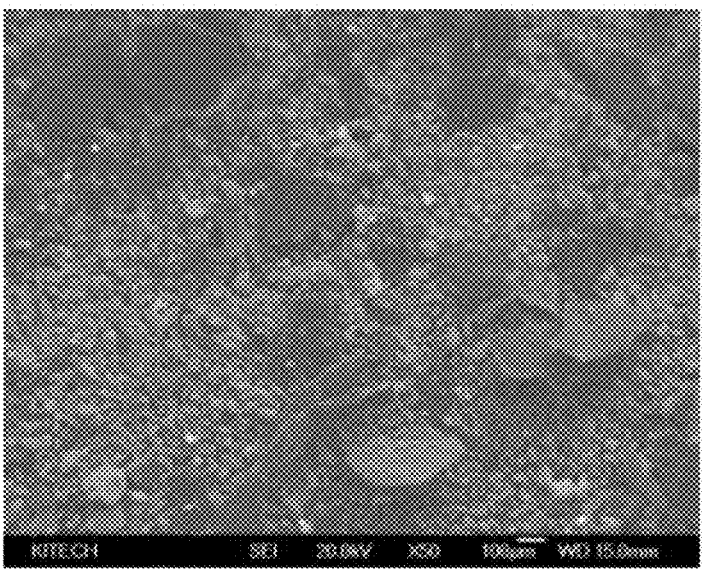
Figure 12C:
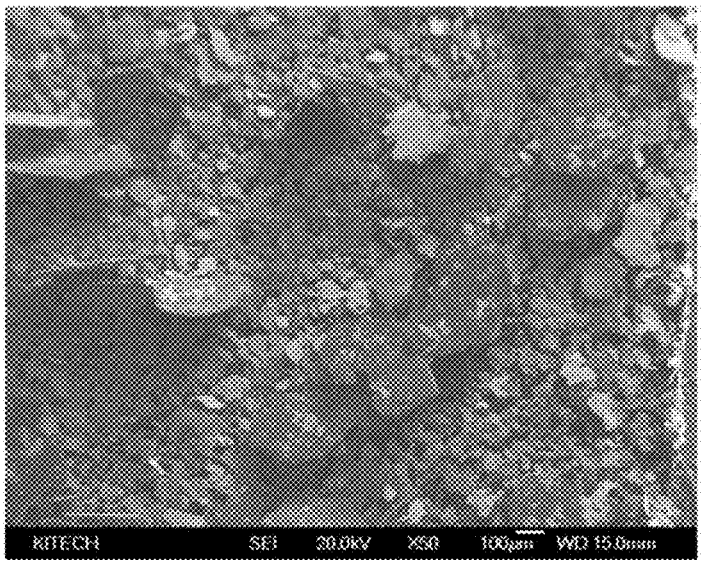
Figure 13:
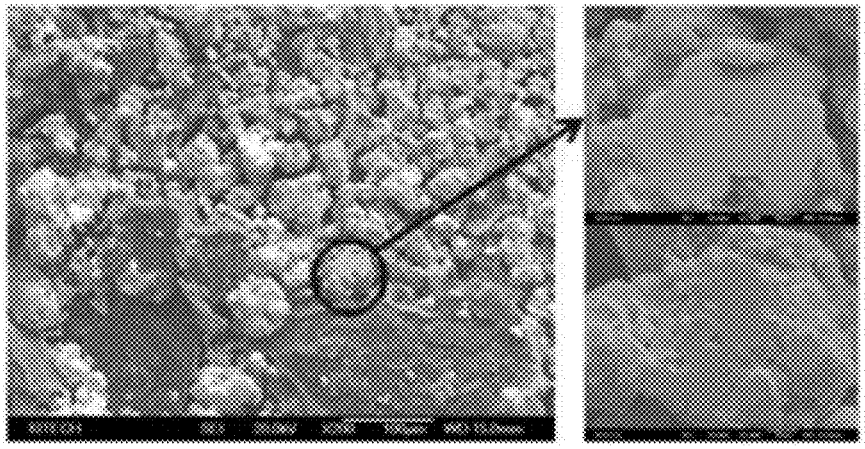
FIG. 13 includes magnified SEM images of a copper powder region after a mixing process using a ball mill is completed.

FIGS. 12A to 12C are SEM images showing shapes of mixture powders according to Samples 3, 4, and 6 after a mixing process using a ball mill is completed, and FIG. 13 includes magnified SEM images of a copper powder region of FIG. 12A.

Referring to FIGS. 12A to 12C, when a ball mill is used, compared to FIGS. 11A to 11C, graphite powder which is broken into fragments having a relatively small average size is observed a lot. Referring to FIG. 13, when a ball mill is used, copper powder which is pressure-welded together to cause deformation or form aggregates is observed a lot.

When a ball mill rotates, hard balls collide with the copper powder and the graphite powder while rotating at a high speed. In this process, the copper powder having a high ductility may be deformed and be mechanically pressure-welded together. The graphite powder having a high brittleness may be broken due to collision. Due to the breakage, an average size of the graphite powder is reduced. Fine graphite powder generated as a result of the breakage of the graphite powder is greatly increased.

On the contrary, when a multi-axial mixer is used, only the copper powder and the graphite powder are inserted without inserting a liquid PCA and are mixed merely by mechanical vibration of the multi-axial mixer. Thus, deformation or breakage of the copper powder and the graphite powder due to collision with another hard medium does not occur. Therefore, when a multi-axial mixer is used, heterogeneous powders may be mixed well without considerable variations in shapes of the copper powder and the graphite powder.

Table 2 shows results of analyzing components of mixture powders according to Samples 1 and 3 by using an energy dispersive spectrometer (EDS).

TABLE 2

| | Composition | | |
|---|---|---|---|
| | Carbon (C) | Oxygen (O) | Copper (Cu) |
| Sample 1 (powder) | 21.19 | 0 | 78.81 |
| Sample 3 (powder) | 28.67 | 7.69 | 63.64 |

Referring to Table 2, oxygen is not detected from the mixture powder of Sample 1 using a multi-axial mixer but oxygen is detected from the mixture powder of Sample 3 using a ball mill. In a wet ball milling method, ethanol is inserted to prevent increase in temperature in a container and to uniformly mix powders, and a process of drying mixture powder slurry at a high temperature is required after a ball milling process. Thus, the copper powder is oxidized during the ball milling or drying process. Due to the oxidation of the copper powder, when a sintered compact is manufactured, oxides may decompose at a specific temperature and remain as pores in the sintered compact, or may remain as impurities in the sintered compact to degrade thermal properties of the sintered compact. On the contrary, in a multi-axial mixing method used as a dry method, oxidation of the copper powder, which occurs in the wet ball milling method, is fundamentally prevented.

In the powder manufactured using the above-described wet ball milling method, coarse graphite powder may be broken to generate fine graphite powder, metal powder may be pressure-welded, and the powder may be oxidized. As such, considering a subsequent sintering operation and a final product manufacturing operation, the powder manufactured using the multi-axial mixing method may be used for sintering.

Sintered compacts are manufactured using the mixture powders of Samples 1 to 6 and then properties thereof are compared. A green compact for manufacturing each sintered compact is manufactured according to the second embodiment. Specifically, an operation of filling and pressing a part of the mixture powder in a mold is repeated. A weight of the mixture powder filled in the mold at a time is set to be 5% of a total weight of the mixture powder and the filling and pressing operation is repeated 20 times. The mixture powder is pressed at a pressure of 20 MPa, and a final green compact is manufactured by repeating the filling and pressing operation the set number of times.

After the final green compact is manufactured, as an example of spark plasma sintering, pulsed current sintering is performed at a temperature equal to or higher than 700° C. A pressure of 60 MPa is applied during the sintering process. After the sintering process is completed, the sintered compact is cooled in a chamber and then is taken out.

Figure 14:
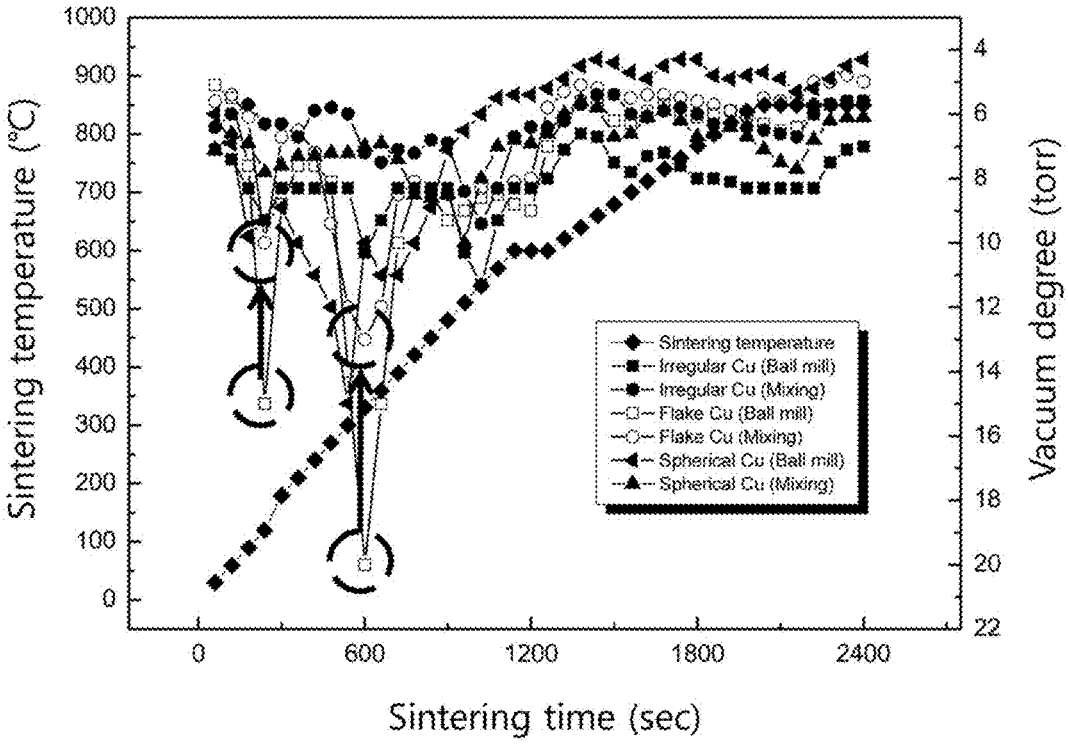
FIG. 14 is a graph showing vacuum level variations in a sintering chamber during a sintering process.

FIG. 14 is a graph showing vacuum level variations in a sintering chamber during a sintering process. Referring to FIG. 14, a vacuum level of the sintering chamber is greatly dropped during the sintering process according to Sample 3 (Spherical Cu (Ball mill)), Sample 4 (Irregular Cu (Ball mill)), and Sample 6 (Flake Cu (Ball mill)) manufactured using a wet ball milling method. On the contrary, such a phenomenon does not occur according to Sample 1 (Spherical Cu (Mixing)), Sample 2 (Irregular Cu (Mixing)), and Sample 5 (Flake Cu (Mixing)) manufactured using a multi-axial mixing method. It is regarded that this is because the quantity of metal oxides generated in the mixture powders of Samples 3, 4, and 6 according to a wet ball milling method is greater than that according to a multi-axial mixing method and the metal oxides decompose and vaporize in a high-temperature vacuum atmosphere to drop the vacuum level. When the metal oxides generated in the mixture powder during the sintering process decompose and vaporize as described above, defects such as unintended pores may occur in the sintered compact and thus a high-density sintered compact may not be manufactured. According to a multi-axial mixing method, such a problem may be prevented in advance.

Figure 15:
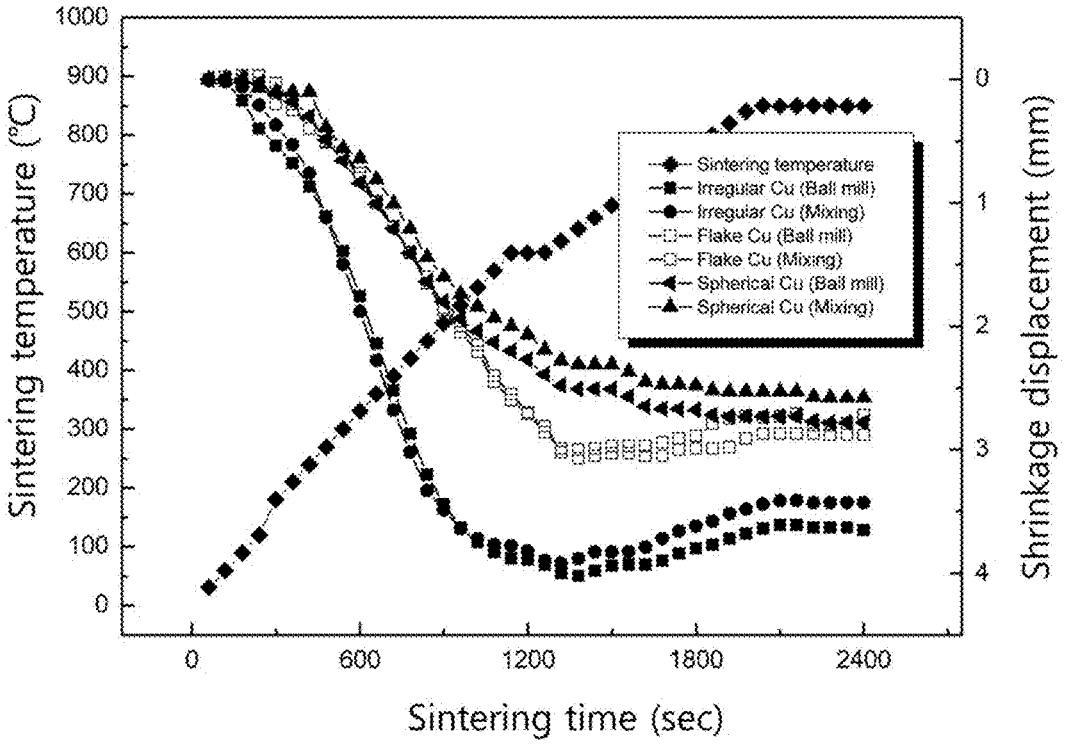
FIG. 15 is a graph showing results of measuring shrinkages of sintered compacts during a sintering process.

FIG. 15 is a graph showing results of measuring shrinkages of sintered compacts during a sintering process. Referring to FIG. 15, Samples 1 and 2 using spherical copper powder show smaller shrinkages during the sintering process compared to the other samples using irregular and flake copper powders. It is regarded that this is because spherical copper powder has a higher fill factor compared to irregular or flake copper powder and thus has smaller voids (or empty spaces between powder particles.

Table 3 shows properties such as a relative density, thermal conductivity, thermal diffusivity, and an orientation control rate of a sintered compact manufactured using mixture powder of each sample.

TABLE 3

| Sample | Relative density (%) | Thermal conductivity (W/mK) | Thermal diffusivity ($mm^2/s$) | Orientation control rate (%) |
|---|---|---|---|---|
| Sample 1 | 99.9 | 602.3 | 244.1 | 96.4 |
| Sample 2 | 97.2 | 402.9 | 175.9 | 83.4 |
| Sample 3 | 99.9 | 427.9 | 180.1 | 85.6 |
| Sample 4 | 97.2 | 448.9 | 182.6 | 86.6 |
| Sample 5 | 99.9 | 529.6 | 212.3 | 87.1 |
| Sample 6 | 93.9 | 334.9 | 143.3 | 81.2 |

Figure 16A:
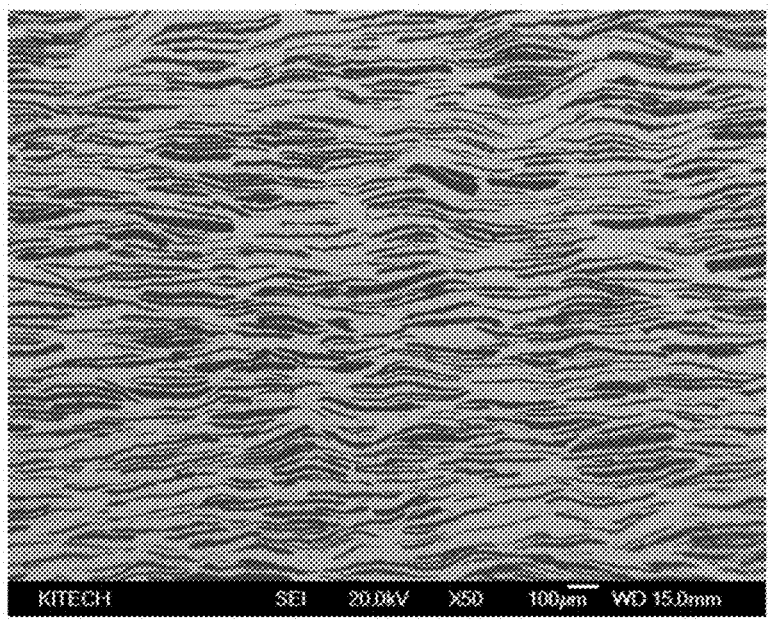
FIGS. 16A to 16D are SEM images showing microstructures of sintered compacts manufactured by performing pulsed current activated sintering on spherical and irregular copper powders manufactured using a multi-axial mixing process and a ball milling process.

FIGS. 16A to 16D are SEM images showing microstructures of sintered compacts according to Samples 1 to 4. Referring to FIG. 16A, Sample 1 shows that flake graphite powder is oriented toward a direction perpendicular to a pressing direction. As shown in Table 3, the relative density is 99.9% which means full densification. In addition, the orientation control rate of graphite powder is 96.4% which is a high property value.

Figure 16B:
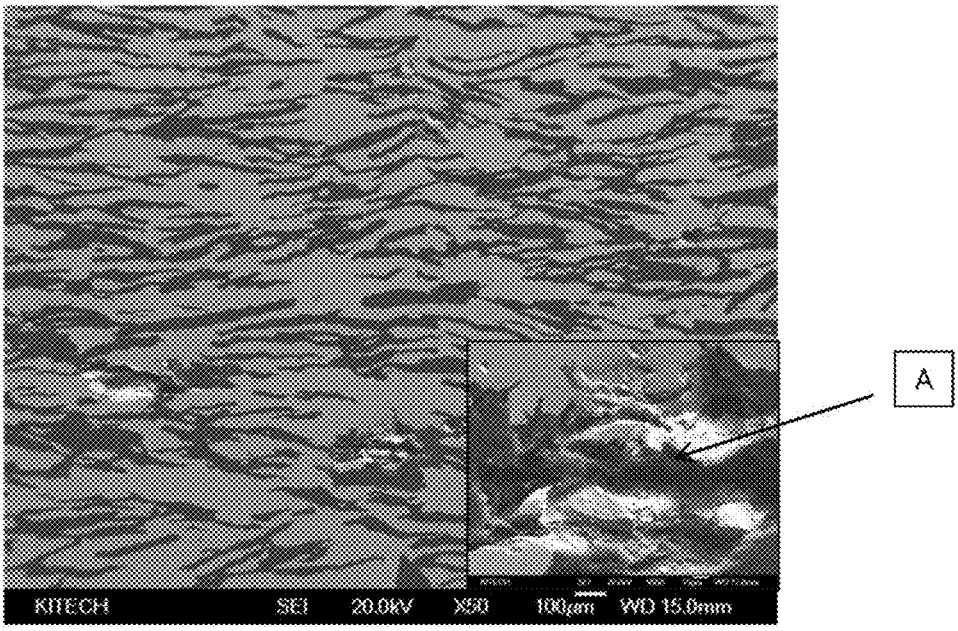
Figure 16C:
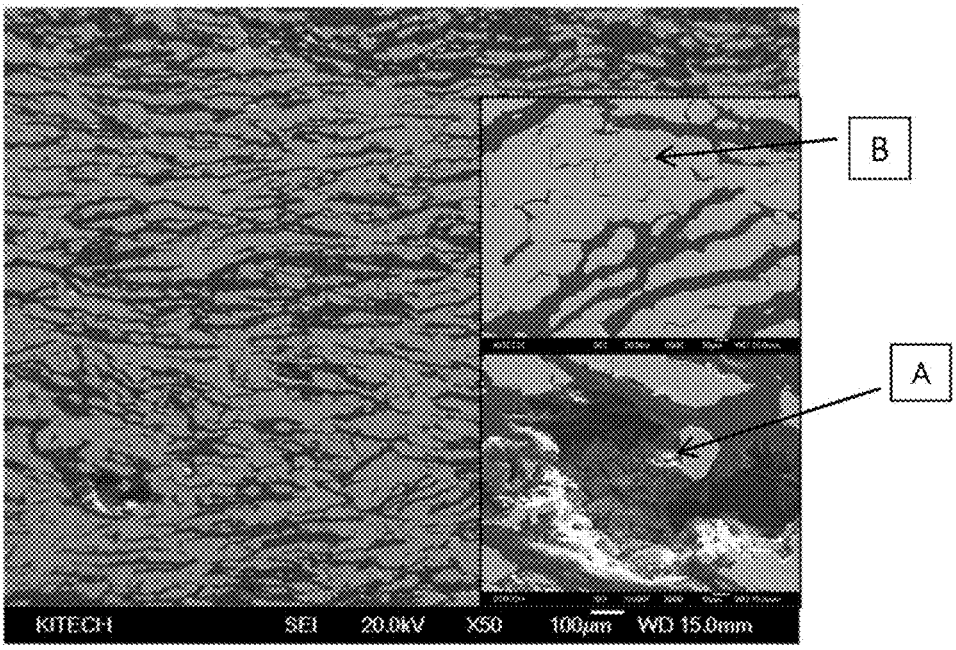

On the contrary, as shown in FIG. 16C, although the same mixture powder as Sample 1 is used, Sample 3 using a ball mill shows a relatively short length of graphite powder and particularly shows many relatively fine graphite powder particles B dispersed between long graphite powder particles. As described above, when a wet ball milling method is used, flake graphite powder is broken by hard balls during the mixing process to generate fine graphite powder. Unlike large graphite powder particles, fine graphite powder particles are not easily controllable in orientation and reduce thermal conductivity due to irregular dispersion thereof. As such, the orientation control rate of graphite powder is shown as 85.6% which is much lower than that of Sample 1.

When a ball mill is used, it is shown that copper powder is pressure-welded together during the mixing process to cause deformation or form aggregates. When the copper powder is locally aggregated, densification may not be performed and thus unintended pores may occur in the sintered compact. FIG. 16C shows a plurality of pores A occurred due to the above-described reason.

Referring to FIG. 16B, Sample 2 mixed using a multi-axial mixing method also shows pores occurred in the sintered compact. It is regarded that this is because irregular copper powder other than spherical copper powder is used and thus densification is not sufficiently performed in regions where irregular surfaces of the copper powder are in contact with each other. As shown in Table 3, the relative density is merely 97.2%. In addition, the orientation control rate is 83.4% which is a low value.

Figure 16D:
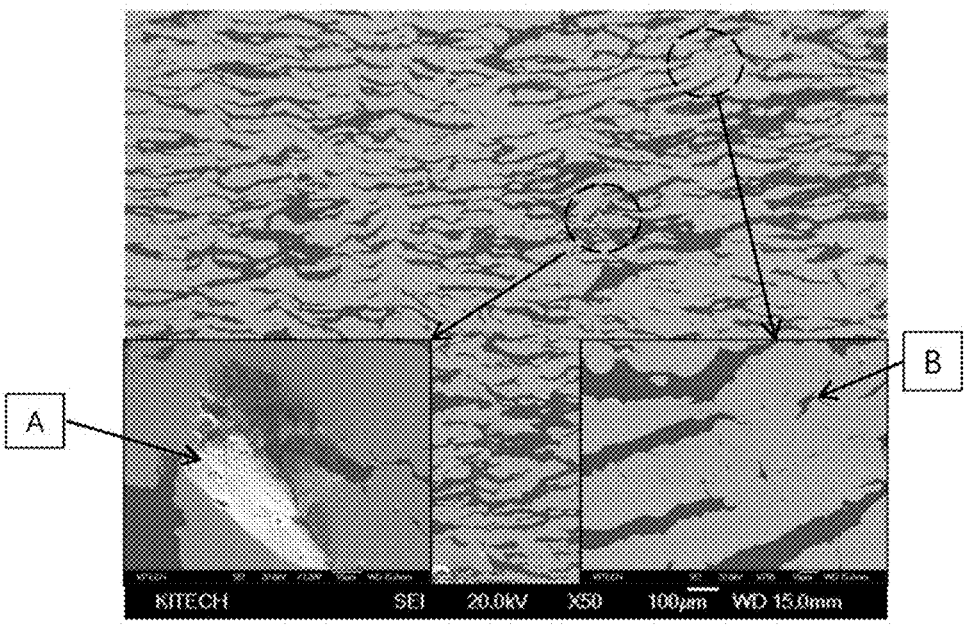

Referring to FIG. 16D, when irregular copper powder and a ball milling method are used together, both of local pores and finely broken graphite powder are observed. In addition, the relative density and the orientation control rate are shown as 97.2% and 86.6% which are low values.

Figure 17A:
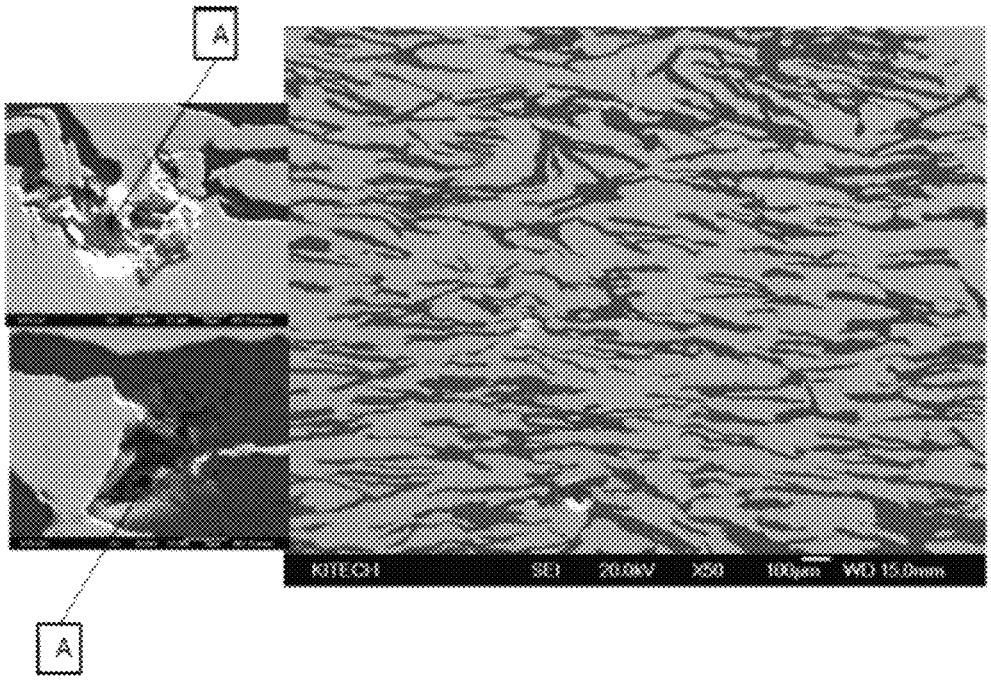
FIGS. 17A and 17B are SEM images showing microstructures of sintered compacts manufactured by performing pulsed current activated sintering on flake copper powders manufactured using a multi-axial mixing process and a ball milling process.
Figure 17B:
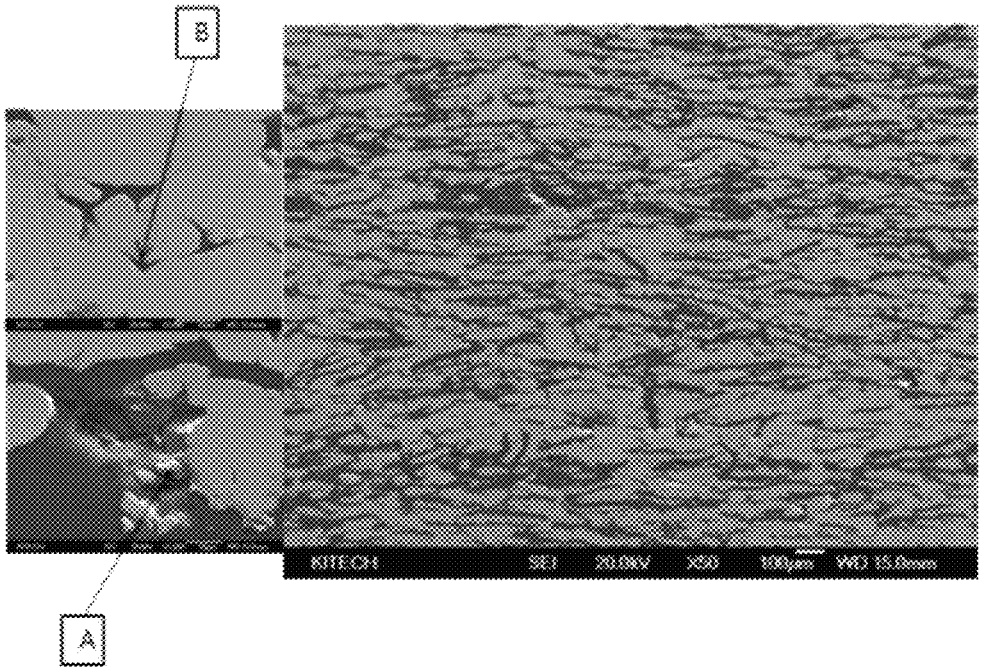

FIGS. 17A and 17B are SEM images showing microstructures of sintered compacts according to Samples 5 and 6. Referring to FIG. 17A, although a multi-axial mixing method is used, Sample 5 includes poorly-oriented graphite powder and locally has pores. Referring to FIG. 17B, fine graphite powder fragments B broken in the ball milling process are observed and pores are locally shown.

Similarly to other samples using a multi-axial mixing method, Sample 5 shows a relative density of 99.9%. However, Sample 6 shows that oxidation is promoted due to the flake powder shape having a large surface area compared to other powder shapes and thus a slightly low relative density of 93.9% is obtained due to pores occurred during the sintering process. In addition, although a multi-axial mixing method is used, when flake copper powder is used, the orientation control rate of graphite powder is shown as 87.1% which is a low value compared to Sample 1.

The thermal conductivity and the thermal diffusivity differ depending on the above-described microstructures of the sintered compacts. Referring to Table 3, Sample 1 shows a high thermal conductivity higher than 600 W/mK but Samples 2 to 4 show thermal conductivities lower than 450 W/mK. In particular, Sample 6 using flake copper powder shows a thermal conductivity of about 335 W/mK which is much lower than that of Sample 1. Furthermore, Sample 1 shows a thermal diffusivity of 244.1 $mm^2/s$ which is a much higher value than those of the other samples.

Based on the microstructure and properties of the final sintered compacts according to different samples in Table 1, it is shown that, when a copper-graphite composite is manufactured using metal powder and graphite powder, both of shapes of the metal powder and the graphite powder and a method of mixing the powders greatly influence properties of the final sintered compact. That is, when a typical ball milling method is used in an operation of mixing flake graphite powder with metal powder to manufacture a sintered compact, flake graphite particles may be broken by hard balls and thus fine graphite powder may be generated. On the other hand, when a multi-axial mixing method is used, powders may be mixed without colliding with any hard medium and thus the above-described problem may be fundamentally prevented.

Even when a multi-axial mixing method is used, the shape of metal powder to be mixed with flake graphite powder also exerts a considerable influence. That is, when the metal powder has a spherical shape, the metal powder is uniformly mixed with flake graphite powder by using a multi-axial mixing method, and a sintered compact shows excellent properties. On the contrary, when flake copper powder and flake graphite powder are used, although a multi-axial mixing method is used, some flake powder particles are oriented toward a direction perpendicular to a pressure direction but other flake powder particles are oriented toward a direction parallel to the pressure direction in a precursor manufacturing process. Since the flake powder particles oriented toward the direction parallel to the pressure direction cause large voids between powder particles in the precursor manufacturing operation, densification is not sufficiently performed in a sintering process and thus excellent sintering properties are not achieved.

As such, it is shown that, to ensure optimal thermal conductivity of a sintered copper-graphite compact, spherical copper powder and flake graphite powder may be used and a dry multi-axial mixing method according to an embodiment of the present invention other than a typical wet ball milling method may be used in a powder mixing process before a green compact manufacturing process.

Based on the above result, tests are performed to observe property variations depending on a composition of mixture powder and the number of pressing operations and a pressure in a green compact manufacturing process in a case when spherical copper powder and flake graphite powder are mixed using a multi-axial mixing method.

Table 4 shows specific conditions of Experimental Examples 1 to 10 and Comparative Example 1.

TABLE 4

| Sample | Mixing ratio (Cu:Gr.) | Filling amount per repetition (%) | Repetition (times) | Pressure (MPa) | Thermal conductivity (W/mK) | Orientation control rate (%) |
|---|---|---|---|---|---|---|
| Experimental Example 1 | 5:5 | 5% | 20 | 20 MPa | 602.3 | 96.4% |
| Experimental Example 2 | 5:5 | 20% | 5 | 20 MPa | 560.4 | 94.3% |
| Experimental Example 3 | 5:5 | 50% | 2 | 20 MPa | 566.0 | 89.1% |
| Experimental Example 4 | 5:5 | 5% | 20 | 60 MPa | 572.1 | 94.4% |
| Experimental Example 5 | 5:5 | 20% | 5 | 60 MPa | 559.5 | 92.5% |
| Experimental Example 6 | 5:5 | 50% | 2 | 60 MPa | 549.1 | 88.3% |
| Experimental Example 7 | 3:7 | 5% | 20 | 20 MPa | 640.3 | 98.7% |
| Experimental Example 8 | 7:3 | 5% | 20 | 20 MPa | 556.1 | 81.2% |
| Experimental Example 9 | — | 5% | 20 | 20 MPa | 478.2 | 91.9% |
| Experimental Example 10 | 5:5 | 100% | 1 | 20 MPa | 547.5 | 78.8% |
| Comparative Example 1 | — | 100% | 1 | 20 MPa | 441.2 | 71.7% |

Experimental Examples 1 to 8 are manufactured according to the second embodiment of the present invention. A multi-axial mixer is used to mix powders according to all experimental examples. An operation of filling and pressing a part of the mixture powder in a mold is repeated. A weight of the mixture powder filled in the mold at a time is set to be 5%, 20%, or 50% of a total weight of the mixture powder. When the weight ratio of the mixture powder filled at a time is 5%, the filling and pressing operation is repeated 20 times. When the weight ratio of the mixture powder filled at a time is 20% or 50%, the filling and pressing operation is repeated 5 times or 2 times. A pressure for pressing the mixture powder is 20 MPa or 60 MPa. A final green compact is manufactured by repeating the filling and pressing operation the set number of times.

Experimental Example 10 corresponds to a final green compact manufactured by filling total mixture powder having a mixing ratio of 5:5, in a mold and then pressing mixture powder one time according to the first embodiment of the present invention.

Experimental Example 9 is manufactured according to the fourth embodiment of the present invention. Specifically, a surface activation process is performed by heating graphite powder at 400° C. for 60 minutes and then a wetting process is performed by adding acetic acid. The graphite powder is coated with a copper film by performing electroless plating on the activated surface of the graphite powder. The surface-activated powder is filled in a mold by a weight ratio of 5% at a time and the above-described filling and pressing operation is repeated.

Comparative Example 1 corresponds to a final green compact manufactured by filling total graphite powder coated with copper based on electroless plating, in a mold, applying vibration to orient the graphite powder in the mold, and then pressing the graphite powder one time.

Figure 18:
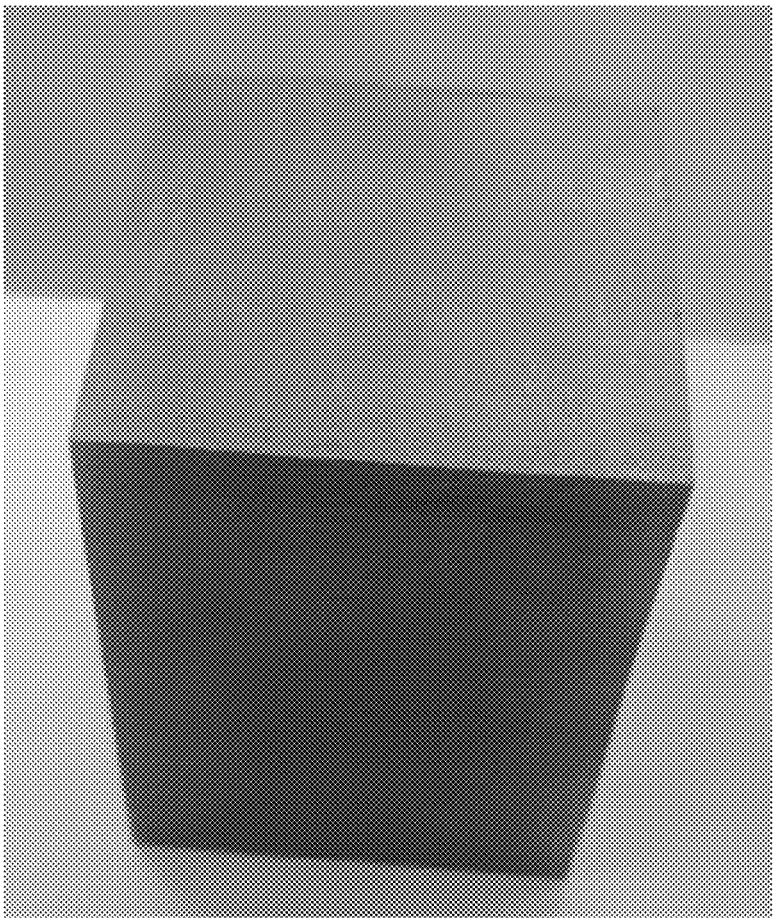
FIG. 18 is a photographic image showing the exterior of a sample according to an experimental example of the present invention.
Figure 19:
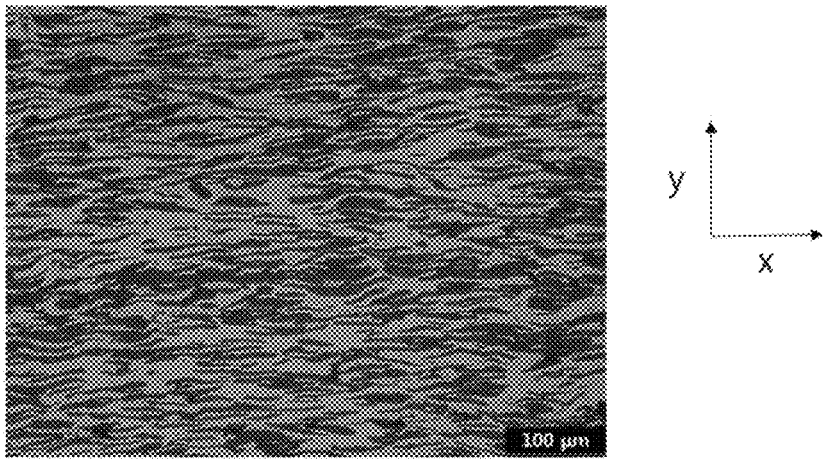
FIG. 19 is an optical microscopic image showing a microstructure of a sintered copper-graphite compact according to an experimental example of the present invention.

FIG. 18 is a photographic image showing the exterior of a sintered compact corresponding to Experimental Example 1, and FIG. 19 is an optical microscopic image showing a microstructure of the sintered compact. Referring to FIG. 19, it is shown that almost all graphite powder particles are oriented toward a direction perpendicular to a pressing direction (e.g., an x-axis direction of FIG. 19).

Thermal conductivity of the sintered sample is measured at room temperature, and a result thereof is shown in Table 4. Referring to Table 4, it is shown that, compared to Experimental Example 10 manufactured by filling and pressing mixture powder in a mold one time, Experimental Examples 1 to 8 manufactured by repeatedly filling and pressing a part of mixture powder in a mold to manufacture a partial green compact, multiple times have higher thermal conductivities. In particular, Experimental Example 1 has a very high thermal conductivity of 602.3 W/mK at room temperature.

It is shown that a higher thermal conductivity is achieved when a pressure of 20 MPa is applied to manufacture a partial green compact, compared to a case in which a pressure of 60 MPa is applied. It is regarded that this is because, when a certain or higher pressure is applied to stack partial green compacts on one another, the graphite powder cracks or locally aggregates due to a difference between densities of copper and graphite. As such, it may be inferred that a certain or higher pressure needs to be applied to mixture powder in a partial green compact manufacturing operation but an excessively high pressure causes reduction in thermal conductivity due to cracks or local aggregation of graphite powder.

It is shown that Experimental Example 10 may remarkably reduce a precursor manufacturing process time due to a single filling and pressing operation, and has a high thermal conductivity of about 550 W/mK in spite of a relatively low orientation control rate compared to the other experimental examples.

Comparatively based on Experimental Example 9 and Comparative Example 1, even when graphite powder coated with a copper film is used, a relatively high thermal conductivity may be achieved by filling and pressing the graphite powder multiple times.

To analyze thermal conductivity based on a degree of orientation of graphite powder in a sintered compact, orientation control rates of graphite powder in different samples are calculated and compared.

Figure 20:
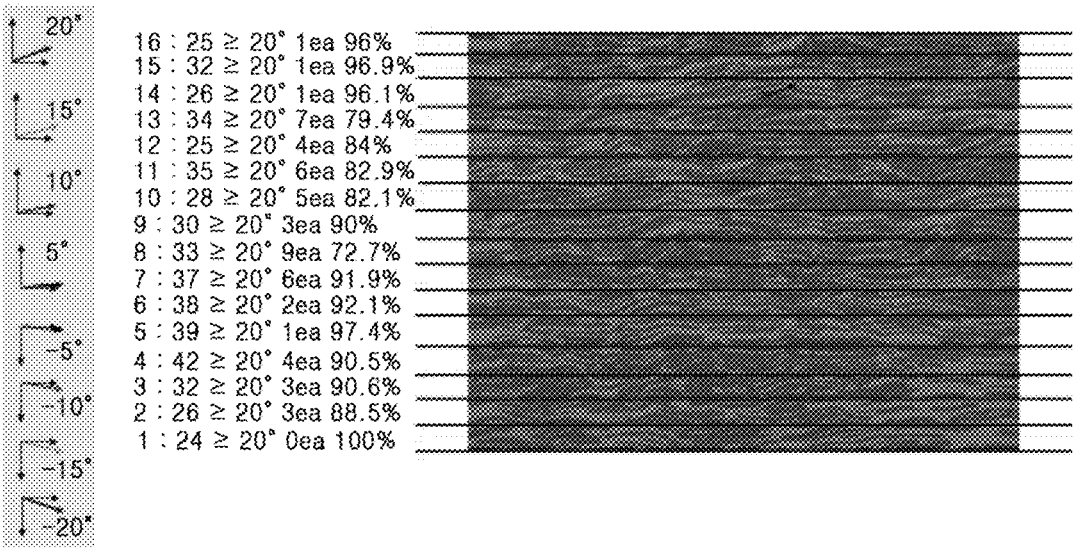
FIG. 20 shows a result of calculating an orientation control rate by using a SEM image of a sintered copper-graphite compact according to an experimental example of the present invention.

FIG. 20 shows an analysis result using a X60 SEM image of a sintered compact manufactured according to Experimental Example 1. A method of calculating an orientation control rate of graphite powder will now be described as an example with reference to FIG. 20.

As illustrated in FIG. 20, 16 lines extending in a direction perpendicular to a pressing direction are drawn at equal intervals and then angles between major axes of graphite powder particles crossing each line, and the direction perpendicular to the pressing direction are measured. Thereafter, the number of graphite powder particles corresponding to angles having an absolute value equal to or less than 20° is calculated and divided by a total number of the measured graphite powder particles and then is converted to a percentage which is defined as an orientation control rate.

Table 4 shows orientation control rates of the test and comparative examples, which are calculated using the above-described method. Referring to Table 4, it is shown that all of Experimental Examples 1 to 9 have high orientation control rates of graphite powder equal to or higher than 88%. On the contrary, Comparative Example 1 has an orientation control rate of 71.7%.

Comparative Example 1 corresponds to a final green compact manufactured by filling total graphite powder coated with a copper film, in a mold, applying certain vibration to orient the graphite powder in the mold, and then pressing the graphite powder one time at 60 MPa. When the powder is filled in the mold and vibration is applied, an effect of orienting the graphite powder may be expected. However, when a repeatedly filling and pressing process for the other experimental examples is not used, an degree of orientation of about 70% is achieved. On the contrary, according to the technical feature of the present invention, a very high degree of orientation of graphite powder higher than 80% may be achieved and thus a high thermal conductivity in a uniaxial direction may be achieved.

Experimental Examples 7, 1, and 8 correspond to copper powder:graphite powder volume ratios of 3:7, 5:5, and 7:3, respectively. Although thermal conductivity differs depending on the volume ratio, all of Experimental Examples 7, 1, and 8 have high thermal conductivities equal to or higher than 550 W/mK. In particular, Experimental Example 7 having the highest degree of orientation has a very high orientation control rate of graphite powder of about 99% and a very high thermal conductivity higher than 640 W/mK.

Experimental Example 9 and Comparative Example 1 have relatively low thermal conductivities compared to Experimental Examples 1 to 8. Experimental Example 9 and Comparative Example 1 correspond to samples manufactured using graphite powder coated with copper based on electroless plating. Therefore, it is regarded that the relatively low thermal conductivities are caused by metal oxides generated due to oxygen included into the film in the electroless plating process, and other impurities. On the contrary, the thermal conductivity reduction phenomenon caused by metal oxides generated due to oxygen included into the film in the electroless plating process does not occur in Experimental Examples 1 to 8.

Table 5 shows a result of analyzing components of mixture powder and a sintered compact according to Experimental Example 1 based on energy-dispersive X-ray spectroscopy (EDS). For comparison, a result of analyzing components of graphite powder coated with a copper film based on electroless plating according to Comparative Example 1 is also shown.

Referring to Table 5, it is shown that oxygen is not detected from both of the copper powder and the sintered compact according to Experimental Example 1. On the other hand, a high content of oxygen is detected from the copper film coated on the graphite powder according to Comparative Example 1. As such, it is shown that, since oxygen is not detected, oxides and impurities which reduce thermal conductivity are not generated in the sample manufactured according to the first embodiment of the present invention.

TABLE 5

| | Element | | | | | |
|---|---|---|---|---|---|---|
| | Carbon (C) | | Oxygen (O) | | Copper (Cu) | |
| Composition | weight % | volume % | weight % | volume % | weight % | volume % |
| Experimental Example 1 (powder) | 21.19 | 51.60 | 0 | 0 | 78.81 | 48.40 |
| Experimental Example 1 (sintered compact) | 22.34 | 53.22 | 0 | 0 | 77.66 | 46.78 |
| Comparative Example 1 (powder) | 23.33 | 49.74 | 3.17 | 10.74 | 73.5 | 39.52 |

As other experimental examples, mixture powder is manufactured using spherical silver (Ag) powder as metal powder based on a multi-axial mixing process and then samples are manufactured using the mixture powder in the same manners as the above-described methods. Table 6 shows conditions of the experimental examples for silver-graphite (Ag-Gr.) heat-dissipating materials in which graphite powder is dispersed in a silver matrix.

TABLE 6

| Sample | Mixing ratio (Ag:Gr.) | Filling amount per repetition (%) | Repetition (times) | Pressure (MPa) | Thermal conductivity (W/mK) | Orientation control rate (%) |
|---|---|---|---|---|---|---|
| Experimental Example 11 | 5:5 | 5% | 20 | 20 MPa | 594.0 | 95.9% |
| Experimental Example 12 | 5:5 | 20% | 5 | 20 MPa | 577.5 | 94.7% |
| Experimental Example 13 | 5:5 | 50% | 2 | 20 MPa | 556.5 | 90.0% |
| Experimental Example 14 | 5:5 | 5% | 20 | 60 MPa | 598.8 | 94.1% |
| Experimental Example 15 | 5:5 | 20% | 5 | 60 MPa | 576.1 | 92.9% |
| Experimental Example 16 | 5:5 | 50% | 2 | 60 MPa | 583.4 | 87.9% |
| Experimental Example 17 | 3:7 | 5% | 20 | 20 MPa | 573.2 | 98.5% |
| Experimental Example 18 | 7:3 | 5% | 20 | 20 MPa | 546.7 | 79.9% |
| Experimental Example 19 | 5:5 | 5% | 20 | 20 MPa | 408.3 | 86.5% |

Experimental Examples 11 to 18 are manufactured according to the second embodiment of the present invention, and a mixture powder manufacturing method and a final green compact manufacturing method are the same as those described above. Experimental Example 19 is manufactured according to the fourth embodiment of the present invention by using graphite powder coated with a silver film based on electroless plating. A final green compact manufacturing method using the graphite powder is the same as that described above.

The manufactured final green compact is inserted into a sintering machine maintained at a vacuum level equal to or lower than $10^{-3}$ torr and then pulsed current sintering is performed at a temperature equal to or higher than 600° C. by applying a pressure of 60 MPa.

Figure 21:
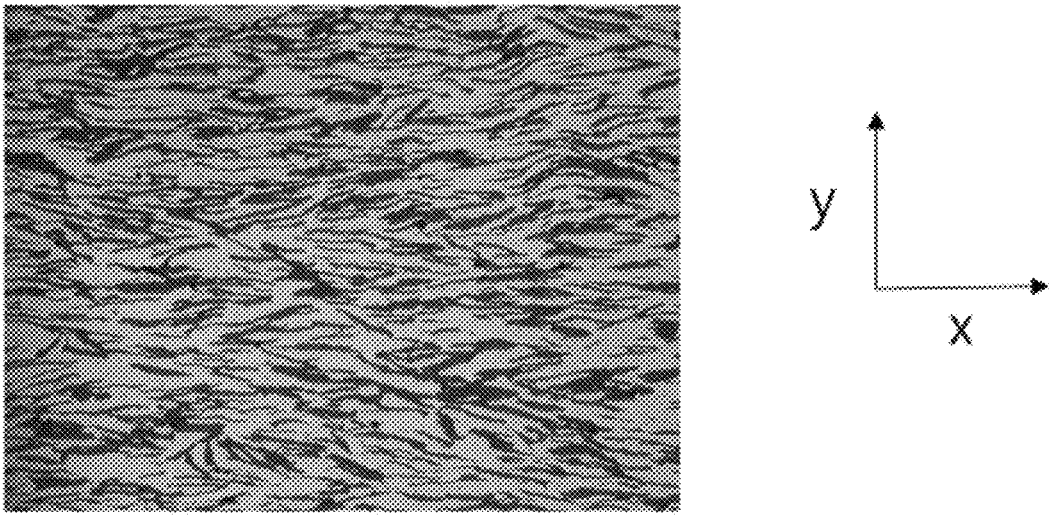
FIG. 21 is an optical microscopic image showing a microstructure of a sintered silver-graphite compact according to an experimental example of the present invention.

FIG. 21 is an optical microscopic image showing a microstructure of a sintered compact corresponding to Experimental Example 10. Referring to FIG. 21, it is shown that almost all graphite powder particles are oriented toward a direction perpendicular to a pressing direction (e.g., an x-axis direction of FIG. 21).

Referring to Table 6, it is shown that all of Experimental Examples 11 to 18 have high orientation control rates of graphite powder equal to or higher than 80%, and high thermal conductivities of about 550 W/mK. It is regarded that Experimental Example 19 has a relatively low thermal conductivity due to oxides and other impurities included in the electroless plating process for coating silver on the graphite powder.

As other experimental examples, mixture powder is manufactured using spherical aluminum powder as metal powder and then samples are manufactured using the mixture powder in the same manners as the above-described methods. Table 7 shows conditions of the experimental examples for aluminum-graphite (Al-Gr.) heat-dissipating materials in which graphite powder is dispersed in an aluminum matrix.

TABLE 7

| Sample | Mixing ratio (Al:Gr.) | Filling amount per repetition (%) | Repetition (times) | Pressure (MPa) | Thermal conductivity (W/mK) |
|---|---|---|---|---|---|
| Experimental Example 20 | 5:5 | 5% | 20 | 20 MPa | 326.5 |
| Experimental Example 21 | 5:5 | 20% | 5 | 20 MPa | 248.4 |
| Experimental Example 22 | 5:5 | 50% | 2 | 20 MPa | 252.4 |
| Experimental Example 23 | 5:5 | 5% | 20 | 60 MPa | 317.0 |
| Experimental Example 24 | 5:5 | 20% | 5 | 60 MPa | 277.1 |
| Experimental Example 25 | 5:5 | 50% | 2 | 60 MPa | 297.7 |
| Experimental Example 26 | 7:3 | 5% | 20 | 20 MPa | 293.9 |

Experimental Examples 20 to 26 shown in Table 7 are manufactured according to the second embodiment of the present invention, and a mixture powder manufacturing method and a final green compact manufacturing method are the same as those described above. The manufactured final green compact is inserted into a sintering machine maintained at a vacuum level equal to or lower than $10^{-3}$ torr and then pulsed current sintering is performed at a temperature equal to or higher than 400° C. by applying a pressure of 60 MPa. Table 7 shows thermal conductivities of the experimental examples.

It is shown that the thermal conductivities are increased by about 1.5 times compared to thermal conductivity of pure aluminum (i.e., 220 W/mK). Although the thermal conductivity is relatively lower than that of copper-graphite, since a weight is reduced to about ¼, the aluminum-graphite heat-dissipating material may be effectively applied to products which require light weight and high performance.

Figure 22:
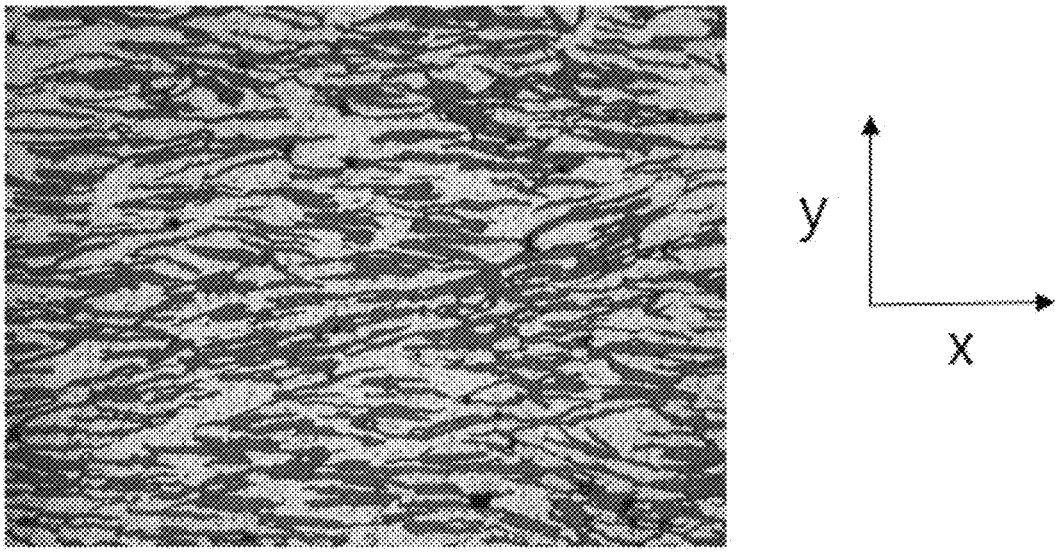
FIG. 22 is an optical microscopic image showing a microstructure of a sintered aluminum-graphite compact according to an experimental example of the present invention.

FIG. 22 is an optical microscopic image showing a microstructure of a sintered compact corresponding to Experimental Example 20. Referring to FIG. 22, it is shown that almost all graphite powder particles are oriented toward a direction perpendicular to a pressing direction (e.g., an x-axis direction of FIG. 22).

As described above, according to an embodiment of the present invention, compared to a typical wet ball milling method for mixing metal powder and graphite powder, when a dry multi-axial mixing method of the present invention is used, breakage due to collision may not occur during a process of mixing spherical metal powder and flake graphite powder and physically uniform mixture may be obtained. A high sinterability may be achieved due to uniform mixture, a locally non-uniform microstructure may be prevented due to uniformly dispersed graphite, and a sintered compact having more uniform properties may be manufactured. Furthermore, thermal conductivity reduction caused by fine graphite powder, which is generated due to breakage of brittle graphite powder in a mixing process and is irregularly dispersed in a sintered compact matrix without being controlled to an intended direction, may be prevented. In addition, a problem of oxidation of metal powder or inclusion of other impurities, which is caused by a wet method, may be fundamentally prevented and thus thermal conductivity reduction due to the oxides or impurities in a final sintered compact may be remarkably suppressed. Besides, by effectively controlling orientation of graphite powder in metal powder toward one direction, thermal conductivity and thermal diffusivity may be greatly improved. However, the scope of the present invention is not limited to the above-described effects.

While the present invention has been particularly shown and described with reference to embodiments thereof, it will be understood by one of ordinary skill in the art that various changes in form and details may be made therein without departing from the scope of the present invention as defined by the following claims.

What is claimed is:

1. A method of manufacturing a metal hybrid, heat-dissipating material, comprising the steps of:

(a) preparing a spherical metal powder and a flake graphite powder having an aspect ratio greater than 1 and coated with a metal film comprising a metal, respectively;

(b) preparing a powder mixture by inserting only the spherical metal powder and the flake graphite powder into a container, without any liquid input and without any mixing aids, followed by dry mixing the powder mixture using a multi-axial mixing method that sequentially rotates or vibrates the container itself about two or more different rotation axes that each fall within or pass through the container;

(c) manufacturing a green compact by pressing the powder mixture; and (d) sintering the green compact to provide said metal hybrid, heat-dissipating material.

2. The method of claim 1, wherein the powder mixture has a variation in a median of sizes before and after step (b) that is not greater than 3%.

3. The method of claim 1, wherein manufacturing the green compact takes place in stages comprising:

filling an initial portion of the powder mixture into a mold to provide a partially filled mold;

manufacturing a partial green compact by uniaxially pressing the partially filled mold; and manufacturing a final green compact by repeatedly filling another partial portion of the powder mixture onto the partial green compact to provide a subsequently, partially filled mold followed by uniaxially pressing the subsequently, partially filled mold one or more times, wherein said green compact comprises the final green compact.

4. The method of claim 1, wherein, in step (c), an orientation control rate has a value equal to or higher than 70% and is defined as a rate by which an angle between the graphite powder and a direction perpendicular to a pressing direction is controlled to have an absolute value equal to or less than 20°.

5. The method of claim 1, wherein the metal powder comprises a metal selected from the group consisting of copper (Cu), silver (Ag), aluminum (Al), tungsten (W), titanium (Ti), molybdenum (Mo), gold (Au), nickel (Ni), and alloys thereof.

6. The method of claim 1, wherein the metal powder has a size ranging from 1 μm to 100 μm.

7. The method of claim 1, wherein the metal film comprises a metal selected from the group consisting of Cu, Ag, Ni, and combinations thereof.

8. The method of claim 7, wherein the metal film is coated by a method selected from the group consisting of electroless plating, electroplating, physical vapor deposition (PVD), and chemical vapor deposition (CVD).

9. The method of claim 1, wherein the graphite powder has a size ranging from 1 μm to 1,000 μm.

10. The method of claim 1, wherein the metal powder and the graphite powder are mixed at a volume ratio ranging from 3:7 to 7:3.

11. The method of claim 3, wherein the initial portion has a weight ratio of the powder mixture filled into the mold to a total powder mixture that is higher than 0.04 and lower than 1.

12. The method of claim 1, wherein, in step (c), the uniaxial pressing is performed at a value ranging from 10 MPa to 100 MPa.

13. The method of claim 1, wherein, in step (d), the sintering is performed using a method selected from the group consisting of high-temperature sintering, hot pressing, and spark plasma sintering.

* * * * *